US010294001B2

(12) United States Patent
Fitzwater et al.

(10) Patent No.: US 10,294,001 B2
(45) Date of Patent: May 21, 2019

(54) PACKAGE FOR A PRODUCT

(71) Applicant: Graphic Packaging International, Inc., Atlanta, GA (US)

(72) Inventors: Kelly R. Fitzwater, Lakewood, CO (US); Karen L. Mills, Limerick, PA (US); Raymond S. Kastanek, Mead, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 135 days.

(21) Appl. No.: 14/919,072

(22) Filed: Oct. 21, 2015

(65) Prior Publication Data

US 2016/0107814 A1 Apr. 21, 2016

Related U.S. Application Data

(60) Provisional application No. 62/122,453, filed on Oct. 21, 2014, provisional application No. 62/282,838, filed on Aug. 12, 2015.

(51) Int. Cl.

| | |
|---|---|
| ***B65D 75/00*** | (2006.01) |
| ***B65D 75/38*** | (2006.01) |
| ***B65D 65/02*** | (2006.01) |
| ***B65D 75/52*** | (2006.01) |
| ***B65D 30/20*** | (2006.01) |

(Continued)

(52) U.S. Cl.

CPC ..... *B65D 75/38* (2013.01); *B65D 31/10* (2013.01); *B65D 65/02* (2013.01); *B65D 65/08* (2013.01); *B65D 65/10* (2013.01); *B65D 75/14* (2013.01); *B65D 75/52* (2013.01); *B65D 75/525* (2013.01); *B65D 77/02* (2013.01); *B65D 85/36* (2013.01); *A47G 21/001* (2013.01)

(58) Field of Classification Search

USPC ..... 229/87.08, 87.5, 938, 87.01, 103.2, 150; 206/1.5

See application file for complete search history.

(56) References Cited

U.S. PATENT DOCUMENTS 1,453,756 A * 5/1923 Dewey ..... B65D 27/08 229/87.5

1,474,088 A 11/1923 Reynolds (Continued)

FOREIGN PATENT DOCUMENTS

| | | |
|---|---|---|
| CA | 2 384 311 | 3/2001 |
| CA | 2 586 472 | 5/2006 |

(Continued)

OTHER PUBLICATIONS

International Search Report and Written Opinion for PCT/US2015/056617 dated Jan. 28, 2016.

(Continued)

*Primary Examiner* — Jacob K Ackun

(74) *Attorney, Agent, or Firm* — Womble Bond Dickinson (US) LLP

(57) ABSTRACT

A package for holding a product. The package can comprise a liner for at least partially receiving the product and at least partially wrapping around the product. The package further can comprise a construct wrapped at least partially around the liner. The construct can comprise a first portion and a second portion, the first portion at least partially overlapping and engaging the second portion.

19 Claims, 35 Drawing Sheets

(51) Int. Cl.

| | |
|---|---|
| ***B65D 65/08*** | (2006.01) |
| ***B65D 65/10*** | (2006.01) |
| ***B65D 77/02*** | (2006.01) |
| ***B65D 85/36*** | (2006.01) |
| ***B65D 75/14*** | (2006.01) |
| *A47G 21/00* | (2006.01) |

(56) References Cited

U.S. PATENT DOCUMENTS 1,516,090 A 11/1924 Gary et al.
1,664,111 A 3/1928 Johnson
2,004,098 A * 6/1935 Andrews ..... B65D 75/02 206/526
2,099,257 A 11/1937 Bergstein
2,107,946 A 2/1938 Inman
2,132,966 A 11/1938 O'Brien
2,166,388 A 7/1939 Bergstein
2,197,113 A 4/1940 Piazze
2,250,249 A 7/1941 Bergstein
2,282,207 A 5/1942 Palmer
2,286,465 A 6/1942 Erlin
RE23,029 E * 8/1948 Delson ..... B42F 7/00 206/37
RE23,096 E 4/1949 Mullinix
2,553,923 A 5/1951 Lambert
2,817,473 A 12/1957 Foster
2,835,435 A 5/1958 Mullinix
2,870,023 A * 1/1959 Vogt ..... B65D 71/00 229/120.011
2,913,161 A 11/1959 Travis
2,987,402 A 6/1961 Dold
3,003,207 A * 10/1961 Powers ..... A47G 21/001 229/103.2
3,142,231 A 7/1964 Christensson
3,142,430 A 7/1964 Meyers
3,240,419 A 3/1966 Spiering et al.
3,249,286 A 5/1966 Palmer
3,250,454 A 5/1966 Steiger
3,272,423 A 9/1966 Bjarno
3,324,998 A 6/1967 Farquhar
3,357,631 A 12/1967 Aid et al.
3,375,968 A * 4/1968 Weiss ..... B65D 71/16 206/139
3,391,782 A * 7/1968 Kaspar ..... A47G 21/001 206/525
3,399,818 A 9/1968 Stegner
3,428,235 A 2/1969 Randazzo
3,443,681 A 5/1969 Wysocki
3,482,758 A 12/1969 LaPierre
3,515,333 A 6/1970 Kotkas et al.
3,589,593 A * 6/1971 Weiss ..... B65D 71/16 206/140
3,627,541 A 12/1971 Farquhar
3,637,130 A 1/1972 Farquhar
3,659,777 A 5/1972 Kanada et al.
3,847,282 A 11/1974 Collura et al.
3,945,870 A 3/1976 Johnsen
3,964,669 A * 6/1976 Sontag ..... B65D 75/28 220/62.13
4,082,216 A 4/1978 Clarke
4,137,333 A 1/1979 Daswick
4,196,035 A 4/1980 Reil
4,221,320 A 9/1980 Faller
4,228,945 A 10/1980 Wysocki
4,267,955 A 5/1981 Struble
4,284,205 A 8/1981 Hirata
4,312,451 A 1/1982 Forbes, Jr.
4,313,542 A 2/1982 Roberts et al.
4,398,636 A 8/1983 Baxter
4,457,483 A 7/1984 Gagne
4,477,014 A 10/1984 Brandenburger
4,478,351 A 10/1984 Homma
4,484,683 A 11/1984 Werner, Jr.
4,494,785 A 1/1985 Song
4,526,316 A * 7/1985 Sutherland ..... B65D 71/14 206/140
4,575,000 A * 3/1986 Gordon ..... B65D 75/28 229/103
4,611,754 A * 9/1986 Sutherland ..... B65D 71/14 206/140
4,627,223 A 12/1986 Janhonen
4,754,914 A 7/1988 Wischusen, III
4,775,771 A 10/1988 Pawlowski
4,785,696 A 11/1988 Martiny
4,865,921 A 9/1989 Hollenberg
4,890,439 A 1/1990 Smart
4,919,785 A 4/1990 Willey et al.
4,930,639 A 6/1990 Rigby
4,936,935 A 6/1990 Beckett
4,940,200 A 7/1990 Sawyer
4,944,603 A 7/1990 Cornish
4,963,424 A 10/1990 Beckett
5,028,147 A 7/1991 Graham
5,034,234 A 7/1991 Andreas et al.
5,071,062 A 12/1991 Bradley et al.
5,078,273 A 1/1992 Kuchenbecker
5,080,643 A 1/1992 Mitchell et al.
5,093,364 A 3/1992 Richards
5,096,723 A 3/1992 Turpin
5,117,078 A 5/1992 Beckett
5,123,527 A 6/1992 Hustad
5,132,124 A 7/1992 Tamaki et al.
5,175,404 A 12/1992 Andreas et al.
5,213,902 A 5/1993 Beckett
5,221,419 A 6/1993 Beckett
5,260,537 A 11/1993 Beckett
5,266,386 A 11/1993 Beckett
5,311,984 A 5/1994 Harris
5,326,022 A 7/1994 Green
5,330,099 A 7/1994 Beales et al.
RE34,683 E 8/1994 Maynard
5,337,951 A 8/1994 Roccaforte
5,340,436 A 8/1994 Beckett
5,346,311 A 9/1994 Siler et al.
5,354,973 A 10/1994 Beckett
5,398,870 A * 3/1995 Bienaime ..... B65D 71/12 229/103.2
5,410,135 A 4/1995 Pollart
5,424,517 A 6/1995 Habeger
5,484,100 A 1/1996 Rigby
5,492,269 A 2/1996 Sung
5,510,132 A 4/1996 Gallo, Jr.
5,519,195 A 5/1996 Keefer
5,540,381 A 7/1996 Davis
5,542,536 A * 8/1996 Sutherland ..... B65D 71/36 206/140
5,585,027 A 12/1996 Young
5,628,921 A 5/1997 Beckett
5,672,407 A 9/1997 Beckett
5,688,427 A 11/1997 Gallo, Jr.
5,743,402 A 4/1998 Gics
5,759,422 A 6/1998 Schmelzer
5,800,724 A 9/1998 Habeger
5,900,263 A 5/1999 Gics
5,921,681 A 7/1999 Money
5,938,110 A 8/1999 Bernstein
5,964,161 A 10/1999 Conway
6,026,953 A 2/2000 Nakamura et al.
6,063,415 A 5/2000 Walters
6,092,664 A 7/2000 Bartosek
6,114,679 A 9/2000 Lai
6,132,351 A 10/2000 Lotto et al.
6,139,662 A 10/2000 Forman
6,150,646 A 11/2000 Lai et al.
6,204,492 B1 3/2001 Zeng et al.
6,234,384 B1 5/2001 Capy et al.
6,251,451 B1 6/2001 Zeng
6,254,519 B1 7/2001 Toshima
6,261,616 B1 7/2001 Simpson et al.
6,335,042 B1 1/2002 Money
6,360,941 B1 3/2002 Larsson
6,401,927 B1 6/2002 Sorensen et al.
6,414,290 B1 7/2002 Cole

(56) References Cited

U.S. PATENT DOCUMENTS

| | | | | |
|---|---|---|---|---|
| 6,431,365 | B1 | 8/2002 | Money | |
| 6,433,322 | B2 | 8/2002 | Zeng et al. | |
| 6,455,827 | B2 | 9/2002 | Zeng | |
| 6,494,619 | B1 | 12/2002 | Sulpizio | |
| 6,552,315 | B2 | 4/2003 | Zeng et al. | |
| 6,568,585 | B2 | 5/2003 | Marie | |
| 6,602,528 | B1 * | 8/2003 | Wells | A45C 11/20 220/529 |
| 6,637,646 | B1 | 10/2003 | Muise et al. | |
| 6,677,563 | B2 | 1/2004 | Lai | |
| 6,683,289 | B2 | 1/2004 | Whitmore et al. | |
| 6,695,202 | B2 | 2/2004 | Miess | |
| 6,702,178 | B2 | 3/2004 | Bowers et al. | |
| 6,717,121 | B2 | 4/2004 | Zeng | |
| 6,744,028 | B2 | 6/2004 | Chisholm et al. | |
| 6,765,182 | B2 | 7/2004 | Cole | |
| 6,767,604 | B2 | 7/2004 | Muir, Jr. et al. | |
| 6,783,005 | B2 | 8/2004 | Giblin et al. | |
| 6,869,387 | B2 | 3/2005 | Post et al. | |
| 6,986,920 | B2 | 1/2006 | Forman et al. | |
| 7,019,271 | B2 | 3/2006 | Wnek et al. | |
| 7,051,877 | B2 | 5/2006 | Lin | |
| 7,143,930 | B2 | 12/2006 | Money et al. | |
| 7,414,230 | B2 | 8/2008 | Fitzwater | |
| D577,295 | S | 9/2008 | Miller et al. | |
| 7,473,875 | B2 | 1/2009 | Fitzwater | |
| 7,510,515 | B2 | 3/2009 | Ichikawa | |
| 7,604,155 | B2 | 10/2009 | Bossel et al. | |
| 7,667,167 | B2 | 2/2010 | Fitzwater | |
| 7,699,214 | B2 | 4/2010 | Mestre et al. | |
| 7,780,006 | B2 | 8/2010 | Clark, Jr. et al. | |
| 7,819,583 | B2 | 10/2010 | Walker et al. | |
| 7,837,606 | B2 | 11/2010 | Tetenborg et al. | |
| 7,893,389 | B2 | 2/2011 | Fitzwater | |
| 7,982,167 | B2 | 7/2011 | Fitzwater | |
| 8,013,280 | B2 | 9/2011 | Robinson et al. | |
| 8,025,179 | B2 | 9/2011 | Miller et al. | |
| 8,066,137 | B2 | 11/2011 | Sanfilippo et al. | |
| 8,142,077 | B2 | 3/2012 | Iannelli, II et al. | |
| 8,206,033 | B2 | 6/2012 | Sato et al. | |
| 8,231,024 | B2 | 7/2012 | Sanfilippo et al. | |
| 8,309,896 | B2 | 11/2012 | Fitzwater | |
| 8,317,671 | B1 | 11/2012 | Zoeckler | |
| 8,403,819 | B2 | 3/2013 | Zoeckler | |
| 8,403,820 | B2 | 3/2013 | Zoeckler | |
| 8,409,645 | B2 | 4/2013 | Feldmeier et al. | |
| 8,468,782 | B2 | 6/2013 | Michalsky et al. | |
| 8,474,163 | B2 | 7/2013 | Rubin | |
| 8,500,330 | B2 | 8/2013 | Nomura et al. | |
| 8,541,038 | B2 | 9/2013 | Feldmeier et al. | |
| 8,998,069 | B2 | 4/2015 | Woodham et al. | |
| 2002/0084316 | A1 * | 7/2002 | Ikeda | B65D 71/22 229/103.2 |
| 2002/0109361 | A1 * | 8/2002 | Parthenis | A47G 21/001 294/219 |
| 2002/0125304 | A1 | 9/2002 | Scicluna | |
| 2002/0148882 | A1 * | 10/2002 | Bowers | A47G 21/001 229/87.08 |
| 2002/0150658 | A1 | 10/2002 | Morrissette et al. | |
| 2003/0080120 | A1 | 5/2003 | Whitmore et al. | |
| 2003/0185948 | A1 | 10/2003 | Garwood | |
| 2003/0206997 | A1 | 11/2003 | Winkelman et al. | |
| 2004/0101605 | A1 | 5/2004 | Sigel | |
| 2005/0284865 | A1 | 12/2005 | Fogle et al. | |
| 2006/0009339 | A1 | 1/2006 | Sleight et al. | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2007/0023436 | A1 | 3/2007 | Ikegami | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0138247 | A1 | 6/2007 | Fitzwater | |
| 2007/0151888 | A1 | 7/2007 | Bossel et al. | |
| 2008/0308614 | A1 | 12/2008 | Fitzwater | |
| 2009/0039077 | A1 | 2/2009 | Fitzwater | |
| 2009/0214142 | A1 | 8/2009 | Bossel et al. | |
| 2010/0046861 | A1 | 2/2010 | Wilcoxen | |
| 2010/0263332 | A1 | 10/2010 | Files et al. | |
| 2011/0052106 | A1 | 3/2011 | Holmes et al. | |
| 2011/0068044 | A1 | 3/2011 | Sorrentino | |
| 2012/0224794 | A1 | 9/2012 | Veder | |
| 2013/0068653 | A1 | 3/2013 | Lipinski | |
| 2014/0270592 | A1 | 9/2014 | Walsh | |

FOREIGN PATENT DOCUMENTS

| | | |
|---|---|---|
| CN | 102770353 | 11/2014 |
| DE | 20300817 | 4/2003 |
| EP | 0 406 556 | 2/1995 |
| EP | 1 072 526 | 1/2001 |
| EP | 1 424 290 | 6/2004 |
| EP | 1 452 458 | 9/2004 |
| EP | 1 964 785 | 9/2008 |
| EP | 2 368 811 | 8/2012 |
| EP | 2 208 689 | 11/2015 |
| FR | 2 516 481 | 5/1983 |
| FR | 2 665 882 | 2/1992 |
| FR | 2 687 384 | 8/1993 |
| GB | 2 365 000 | 2/2002 |
| GB | 2 419 584 A | 5/2006 |
| JP | 2004-224402 | 8/2004 |
| JP | 2006-076621 | 3/2006 |
| JP | 2008-127067 | 6/2008 |
| JP | 2010-222050 | 10/2010 |
| JP | 2011-251774 | 12/2011 |
| JP | 2012-152901 | 8/2012 |
| WO | WO 2006/052326 | 5/2006 |
| WO | WO 2007/067705 | 6/2007 |
| WO | WO 2008/086277 A2 | 7/2008 |
| WO | WO 2009/023286 | 2/2009 |
| WO | WO 2011/011283 A2 | 1/2011 |
| WO | WO 2013/003149 | 1/2013 |

OTHER PUBLICATIONS

Supplementary European Search Report for EP 15 85 2873 dated Jun. 19, 2018.

* cited by examiner

PACKAGE FOR A PRODUCT

CROSS-REFERENCE TO RELATED APPLICATIONS

This application claims the benefit of U.S. Provisional Patent Application No. 62/122,453, filed on Oct. 21, 2014, and U.S. Provisional Patent Application No. 62/282,838, filed Aug. 12, 2015.

INCORPORATION BY REFERENCE

The disclosures of U.S. Provisional Patent Application No. 62/122,453, which was filed on Oct. 21, 2014, and U.S. Provisional Patent Application No. 62/282,838, filed Aug. 12, 2015, are hereby incorporated by reference for all purposes as if presented herein in their entirety.

BACKGROUND OF THE DISCLOSURE

The present disclosure generally relates to packages for holding products. More specifically, the present disclosure is directed to packages having a reinforcing construct for supporting a liner for containing the product.

SUMMARY OF THE DISCLOSURE

In general, one aspect of the disclosure is directed to a package for holding a product. The package can comprise a liner for at least partially receiving the product and at least partially wrapping around the product. The package further can comprise a construct wrapped at least partially around the liner. The construct can comprise a first portion and a second portion, the first portion at least partially overlapping and engaging the second portion.

In another aspect, the disclosure is generally directed to, in combination, a blank and a liner for forming a package for holding a product. The blank can comprise a first portion and a second portion that are spaced apart from one another along a longitudinal direction. The liner can at least partially overlap the blank. The liner can be for at least partially receiving the product and for at least partially wrapping around the product when the package is formed from the blank and the liner. The blank can be for being wrapped at least partially around the liner and the product when the package is formed from the blank and the liner. The first portion can be for at least partially overlapping and engaging the second portion when the package is formed from the blank and the liner.

In another aspect, the disclosure is generally directed to a method of forming a package holding a product. The method can comprise obtaining a blank comprising a first portion and a second portion that are spaced apart from one another along a longitudinal direction. The method further can comprise disposing a liner to at least partially overlap the blank, positioning the product to be at least partially received by the liner, wrapping the liner at least partially around the product, wrapping the blank at least partially around the liner and the product to form a construct, and engaging the first portion with the second portion so that the first portion at least partially overlaps the second portion.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to packages, constructs, and cartons for holding products or articles such as food products or other articles. Packages according to the present disclosure can accommodate articles of any shape. For purpose of illustration and not for the purpose of limiting the scope of the disclosure, the terms "lower," "bottom," "upper," "top," "front," and "back" indicate orientations determined in relation to erected cartons.

Figure 1:
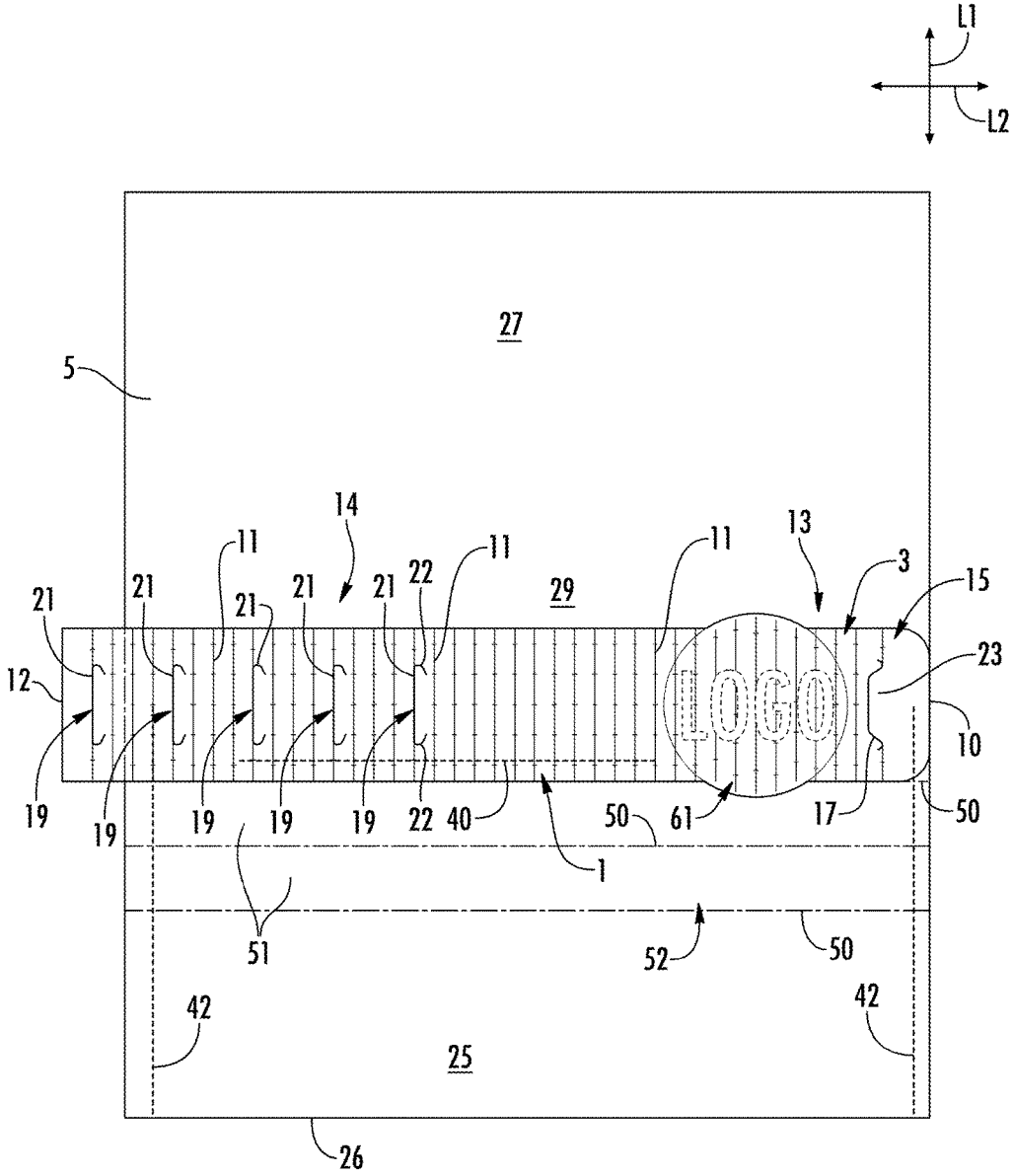
FIG. 1 is a plan view of an exterior surface of a blank and a liner used to form a package according to a first embodiment of the disclosure.
Figure 6:
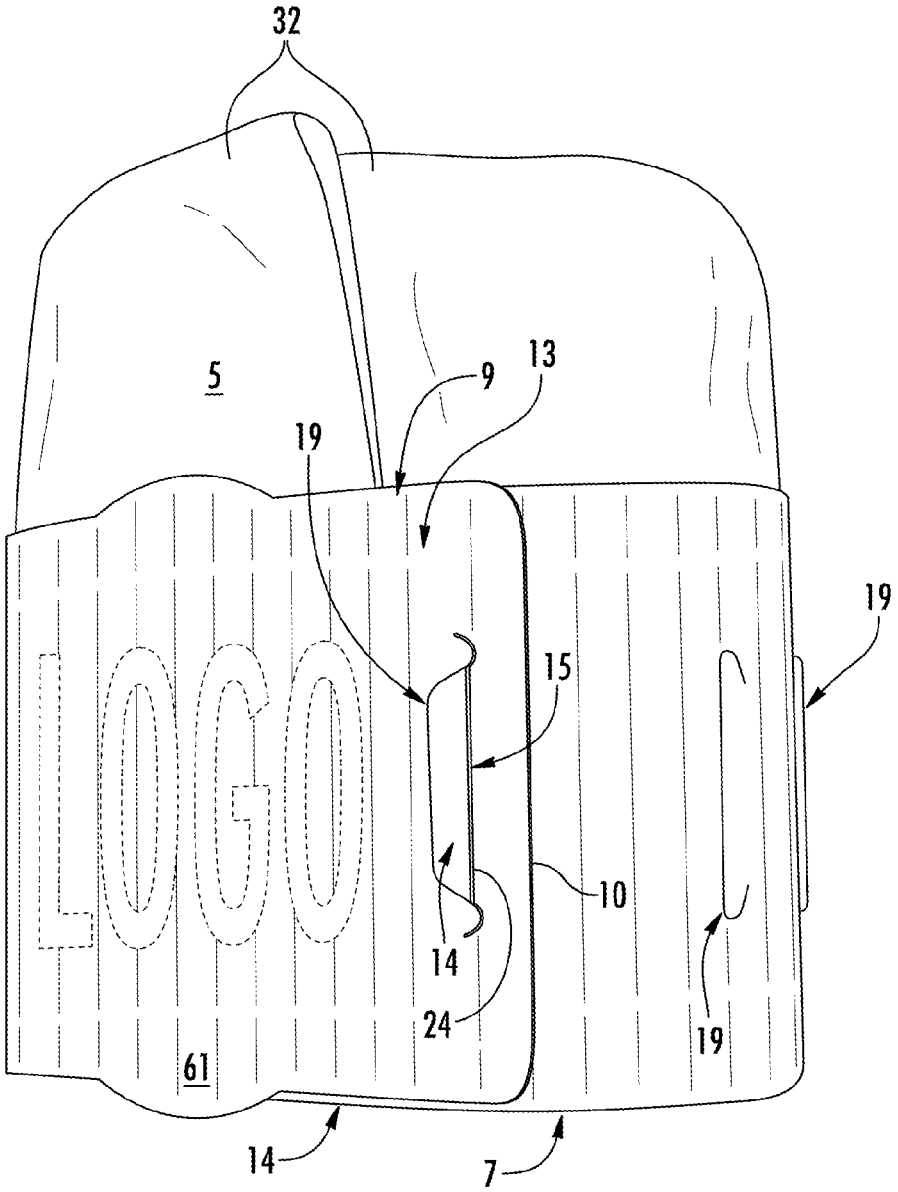
FIG. 6 is a perspective view of the package formed from the blank and the liner of FIG. 1 according to the first embodiment of the disclosure.

FIG. 1 shows an exterior surface 1 of a blank 3 and liner 5 for forming a package 7 (FIG. 6) containing a food product F (FIG. 4) according to a first embodiment of the disclosure. In the illustrated embodiment, the blank 3 forms a wrap or construct 9 that wraps around the food product F and the liner 5 (FIG. 6). The package 7 can contain the food product F, which can be a fast-food item (e.g., sandwich, burrito, wrap, etc.) or any other suitable food item or non-food item. In some embodiments, the construct 9 can act as a holder to be used by a consumer to hold the food product F during consumption. In addition, or alternatively, the construct 9 can be used to carry the food product and reinforce the package 7. Further, the food product F can be contained in the package 7 and placed in a microwave oven for heating prior to consumption, or the food product F can be cooked or heated prior to being placed in the package 7.

In the illustrated embodiment, the liner 5 can comprise a flexible sheet of material, for example, paper, a polymer film, metallic foil, a laminate, etc., that may be suitable for forming a flexible package, such as a pouch, or otherwise may be suitable for wrapping the food product F. The construct 9 may comprise a reinforcing sheet comprising a dimensionally stable and/or somewhat rigid or stiff material (e.g., paperboard) that may be suitable for being folded into a desired structure and substantially maintain its configuration, while providing some inherent degree of flexibility to the package 7. As discussed below, the construct 9 has locking features for securing the construct to the food product F and features for facilitating forming of the construct around the food product.

As shown in FIG. 1, the blank 3 has a lateral axis L1 and a longitudinal axis L2. In the illustrated embodiment, the blank 3 includes a plurality of lateral fold lines 11 extending across the width of the blank 3. In one embodiment, the blank 3 can include a first end 10 and an opposing second end 12. In addition, a first portion 13 can be disposed adjacent the first end 10 and a second portion 14 can be disposed adjacent the second end 12 so that the first portion 13 can at least partially overlap the second portion 14 when the construct 9 is wrapped around the liner 5 and the food item F in the package 7 (FIG. 6). As shown in FIG. 1, the first portion 13 and the second portion 14 can be spaced apart from one another in the longitudinal L2 direction. Stated another way, the blank 3 has a length extending from the first end 10 to the second end 12, and the first portion 13 and the second portion 13 are spaced apart from one another along the length of the blank 3 so that the first portion 13 is closer to the first end 10 and the second portion 14 is closer to the second end 12 along the longitudinal length of the blank 3. The blank 3 can include a product identification panel 61 with a suitable logo adjacent the first end 10 of the blank. The blank 3 could be otherwise shaped, arranged, positioned, and/or configured without departing from the disclosure.

In the illustrated embodiment, a male locking feature 15 can be formed by a cut 17 in the first portion 13 of the blank 3 and a plurality of female locking features 19 can be formed by respective cuts 21 in the second portion 14 of the blank 3. As shown in FIG. 1, the cut 17 is generally U-shaped and has curved ends that curve away from the first end 10 of the blank 3. Accordingly, the cut 17 can form a male locking tab 23 that is directed away from the first end 10. The male locking tab 23 and the cut 17 can interrupt one of the lateral fold lines 11, which can help the male locking tab 23 to pivot with respect to a remainder of the blank so that the male locking tab can be more easily engaged with one of the female locking features 19 (FIG. 6). In one embodiment, the cuts 21 are collinear with a respective lateral fold line 11 and have curved end portions 22 that are curved toward the first end 10 of the blank 3. In the illustrated embodiment, one or more of the cuts 21 can form a respective female locking opening with a locking edge 24 for receiving the male locking tab 23 (FIG. 6). Any of the locking features could be omitted or could be otherwise shaped, arranged, positioned, and/or configured without departing from the disclosure.

As shown in FIG. 1, the liner 5 is disposed on an interior surface of the blank 3 so that the portions of the liner 5 that are covered by the blank 3 are drawn in phantom. In the illustrated embodiment, the liner 5 can include a bottom marginal portion 25, a top marginal portion 27, and a central portion 29 therebetween. The bottom marginal portion 25 can be connected to the central portion 29 by a gusset 52 with two gusset panels 51 (e.g., a first gusset panel and a second gusset panel). The gusset 52 can include three folds 50 in the liner 5 so that the two gusset panels 51 are foldably connected to the respective bottom marginal portion 25 and central portion 29 along respective folds 50, and so that the gusset panels 51 are foldably connected to one another along the intermediate fold 50. In one embodiment, the folds 50 can be generally parallel to the longitudinal axis L2 and to the length of the blank 3. As shown in FIG. 1, the liner 5 (e.g., the central portion 29) can be attached to the blank 3 along a longitudinal glue line 40 (e.g., so that one of the folds 50 is generally aligned with an edge of the blank 3 as shown in FIG. 1). Additionally, the liner 5 can include lateral glue lines 42 for at least partially sealing the end portions of the liner 5 in the package 7 (FIGS. 2-6). The liner 5 could be otherwise shaped, arranged, positioned, and/or configured without departing from the disclosure.

Figure 2:
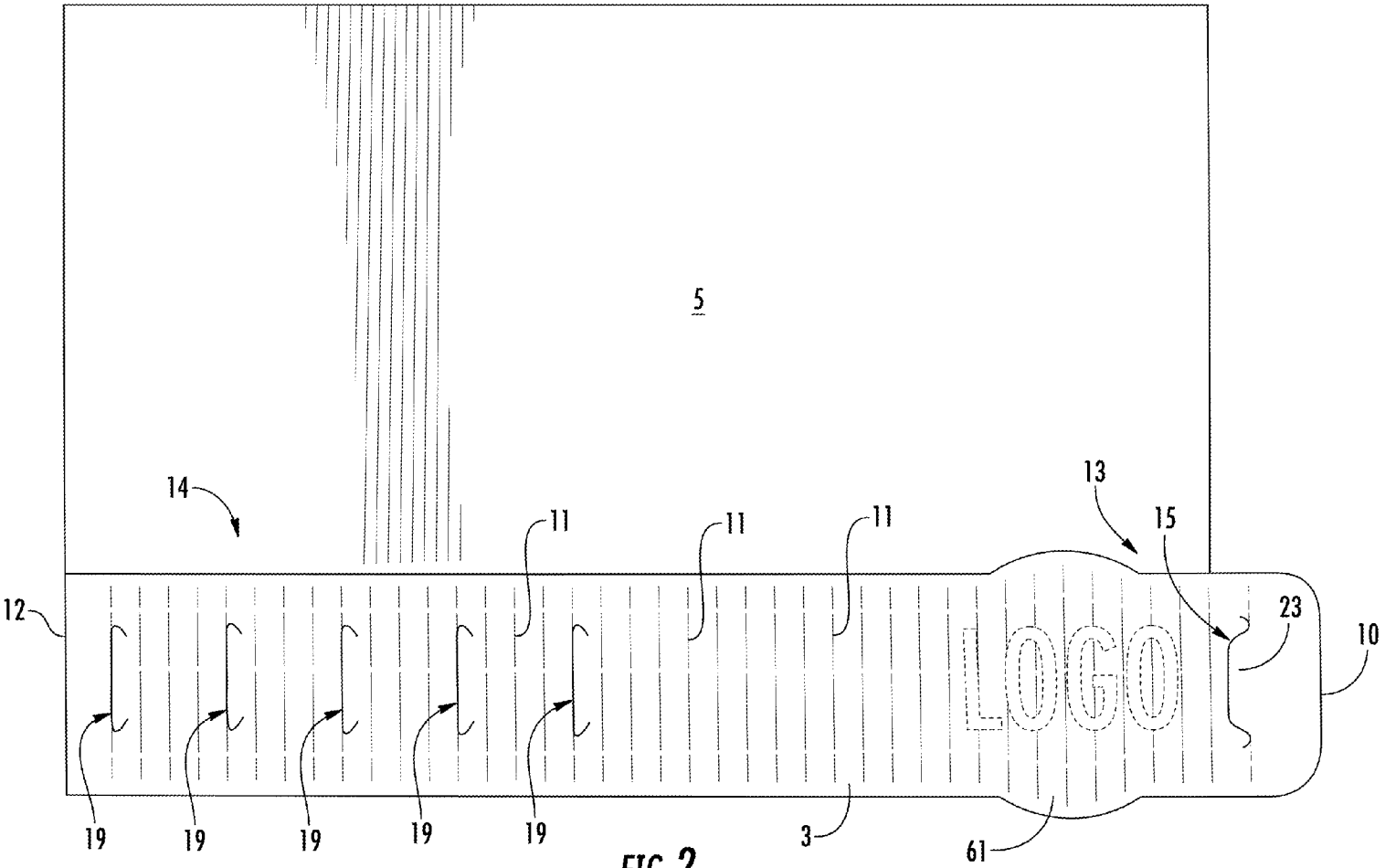
FIGS. 2-5 are views showing the formation of the package from the blank and the liner of FIG. 1 according to the first embodiment of the disclosure.
Figure 3:
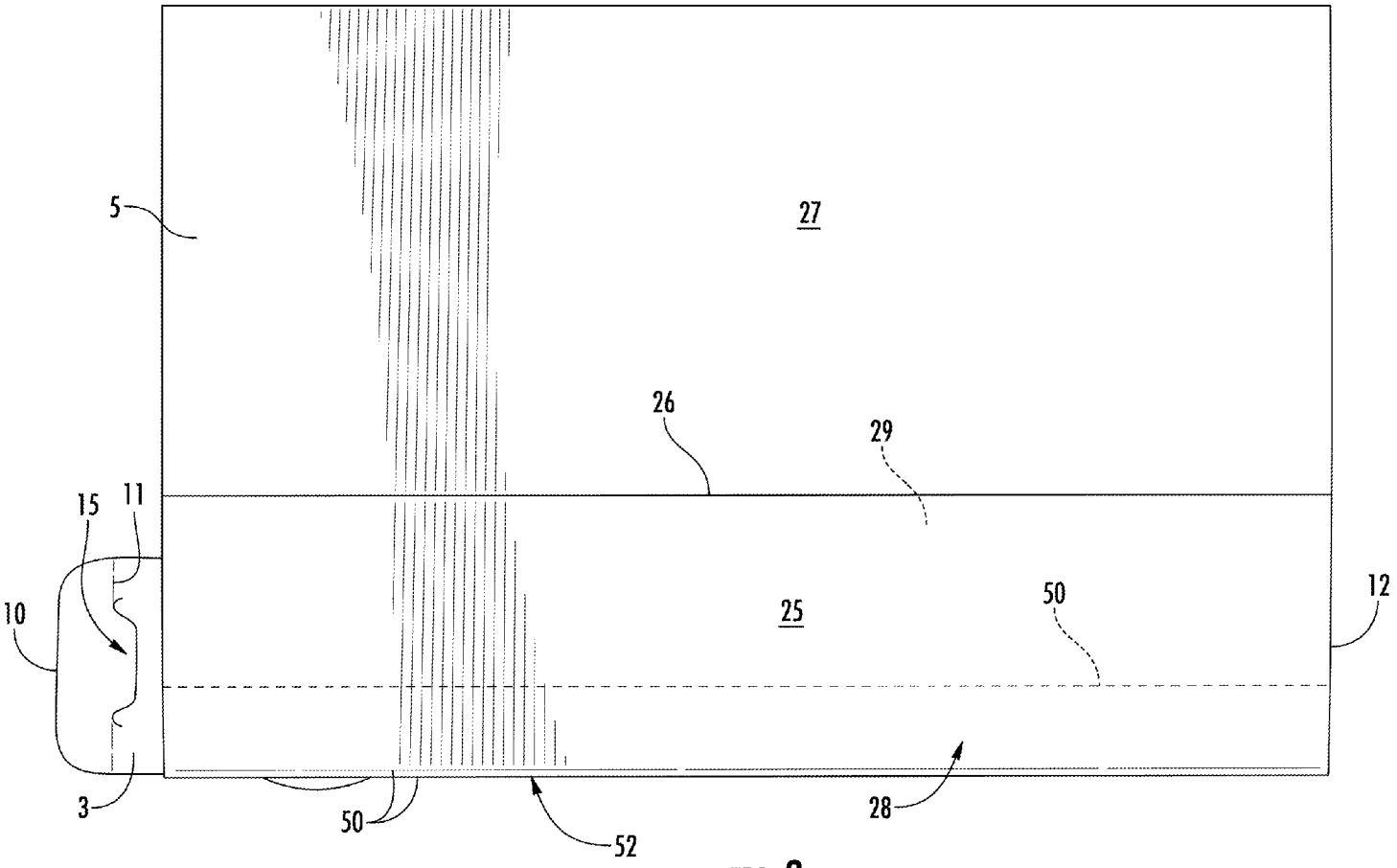
Figure 4:
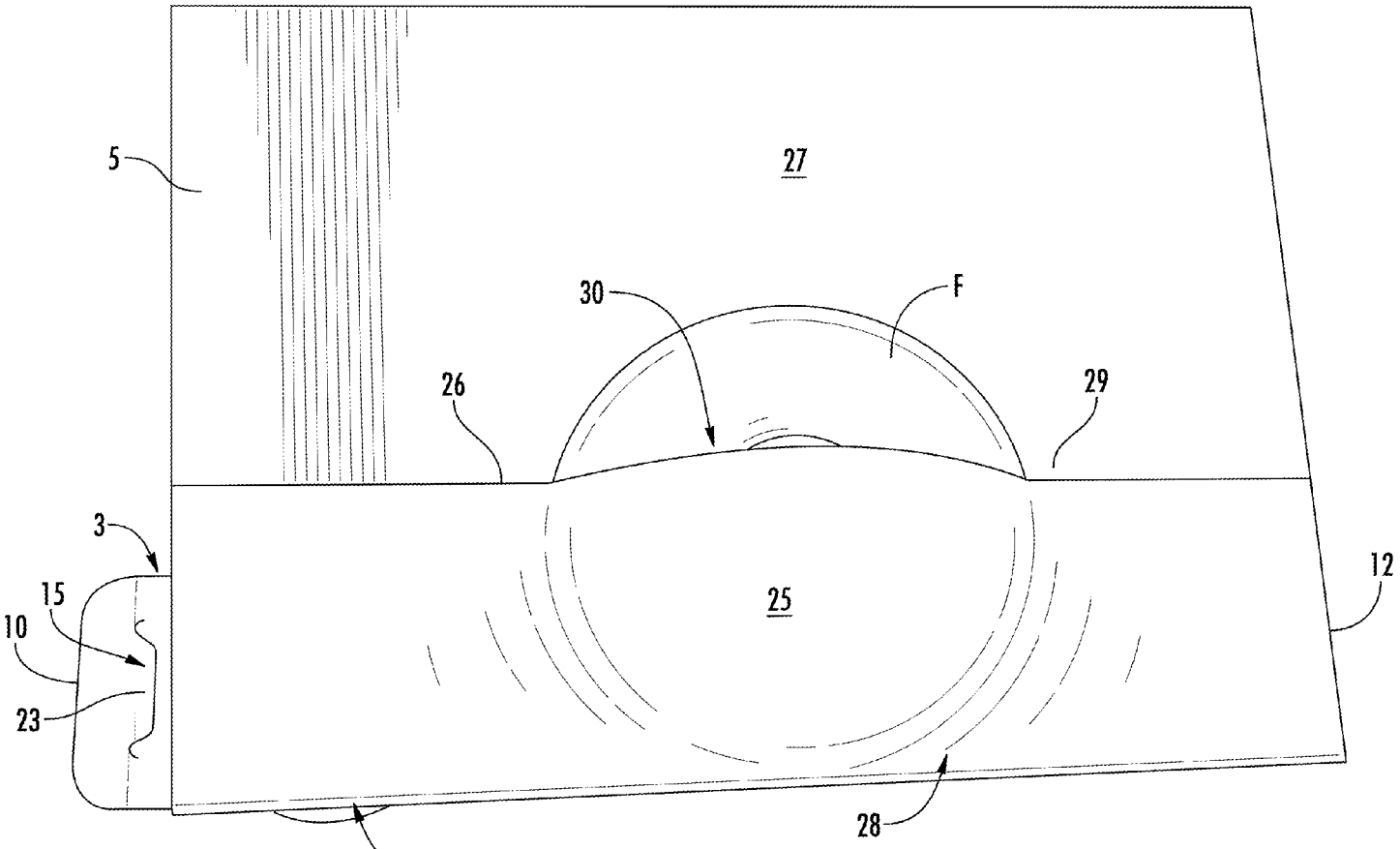

As shown in FIGS. 2 and 3, the bottom marginal portion 25 of the liner 5 can be folded over the central portion 29 of the liner at the gusset 52 to form a pouch 28. The gusset 52 can be folded so that the gusset panels 51 are folded inwardly between the central portion 29 and the bottom marginal portion 25 and form a gusseted bottom of the pouch 28. A bottom edge 26 of the bottom marginal portion 25 and of the liner 5 is disposed to overlay the central portion 29 so that an opening 30 is formed between the central portion 29 and the bottom edge 26 (FIG. 4). The glue lines 42 can generally seal the ends of the pouch 28 adjacent the respective ends 10, 12 of the blank 3. As shown in FIG. 3, the pouch 28 (as well as the bottom edge 26 and the folds 50) extend in the longitudinal direction L2 along the length of the blank 3. The pouch 28 could be otherwise formed without departing from the disclosure.

Figure 5:
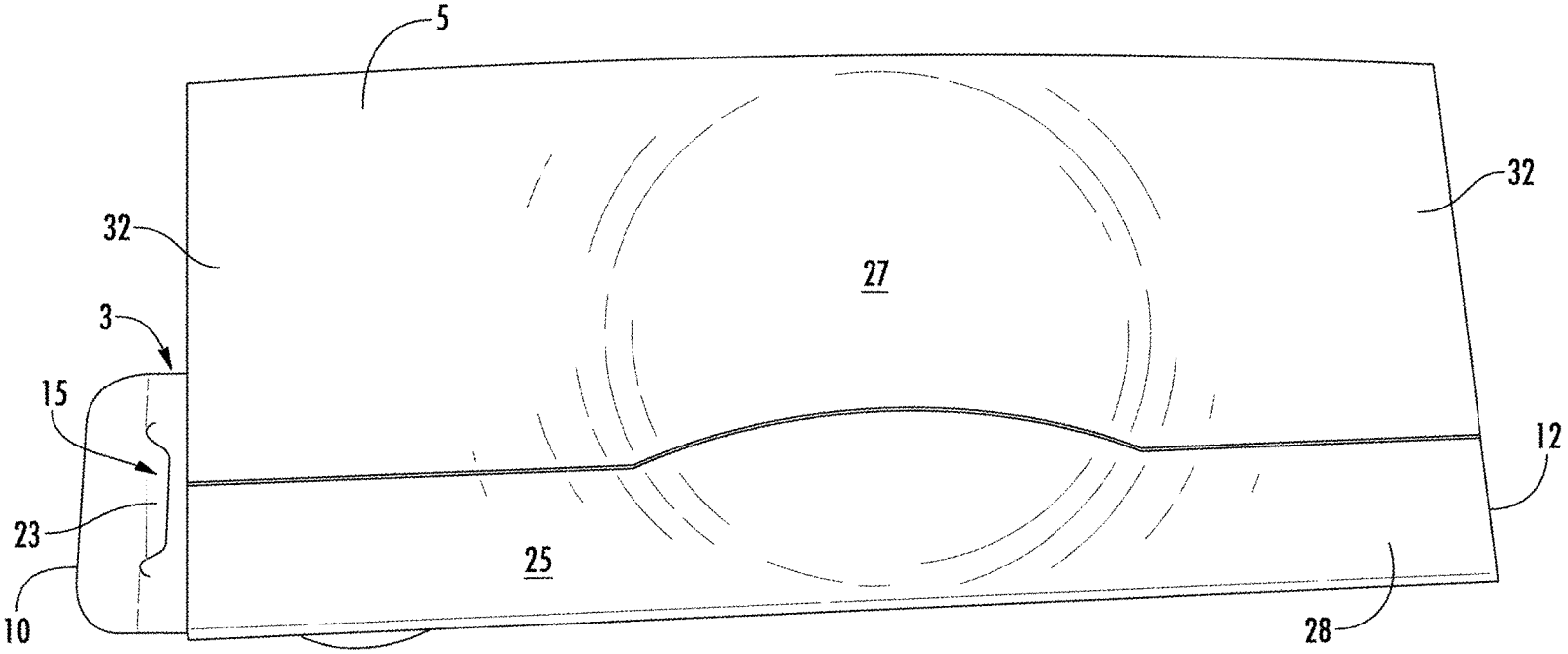

As shown in FIG. 4, a food item F can be inserted through the opening 30 to be at least partially received in the pouch 28 between the bottom marginal portion 25 and the central portion 29 of the liner 5. Subsequently, as shown in FIG. 5, the top marginal portion 27 can be folded over the opening 30 and the pouch 28 to at least partially enclose the food item F in the pouch 28. The liner 5 further can be folded to wrap around the food item F by folding the end margins 32 of the folded liner over the food item F to be in overlapping relationship with one another as shown in FIG. 6.

In the illustrated embodiment, the package 7 can be formed by folding the blank 3 (e.g., along the lateral fold lines 11) around the food item F wrapped in the liner 5 so that the first portion 13 overlaps and engages the second portion 14 to form the construct 9 that encircles the food product (FIG. 6). Accordingly, while the first portion 13 and the second portion 14 are spaced from one another along the length of the construct 9, the wrapping of the construct 9 around the liner 5 and the food item F results in the first portion 13 at least partially overlapping the second portion 14 so that the male locking tab 23 can engage one of the female locking cuts 21. In the illustrated embodiment, the construct 9 is wrapped around the liner 5 and the food product F so that the longitudinal length of the construct is curved around the package 7. The first portion 13 and the second portion 14 of the construct 9 are closer to the respective first end 10 and the second end 12 along this curved length of the construct 9 relative to one another. In one embodiment, the fold lines 11 can facilitate the formation of the construct 9 by allowing the blank 3 to fold and conform to the shape of the food product F.

As shown in FIG. 6, the male locking tab 23 can be aligned with one of the cuts 21 so that the male locking feature 15 can be engaged with one of the female locking features 19. For example, for larger food items F, the male locking feature 15 can engage one of the female locking features 19 closer to the second end 12 of the blank 3, and for smaller food items F, the male locking feature 15 can engage one of the female locking features 19 farther from the second end 12. Generally, the male locking tab 23 is inserted into a selected female locking opening of the female locking feature 19 based on the size of the food product and the desired tightness of the fit of the construct around the food product. As shown in FIG. 6, the male locking tab 23 and the portion of the construct adjacent the first end 10 can be folded along one of the lateral fold lines 11 so that the male locking tab 23 pivots inwardly with respect to the remainder of the construct 9. Accordingly, the male locking tab 23 can be pushed through the cut 21 of the selected female locking feature 19 so that the male locking tab 23 engages the locking edge 24 of the female locking feature 19. The male locking feature 15 can be otherwise engaged with the female locking feature 19 without departing from the disclosure. Additionally, the first portion 13 and the second portion 14 of the construct 9 can be otherwise engaged and/or secured to one another. For example, in addition or alternatively to the male locking feature 15 and the female locking features 19, the first portion 13 and the second portion 14 could be secured together by an adhesive (e.g., an adhesive sticker, retack glue, and/or tape) or any other suitable securing method. In one embodiment, an adhesive sticker and/or any other suitable securing method could be applied to the liner 5 to secure portions of the liner (e.g., the end margins 32) to one another and/or to the construct 9.

Figure 7:
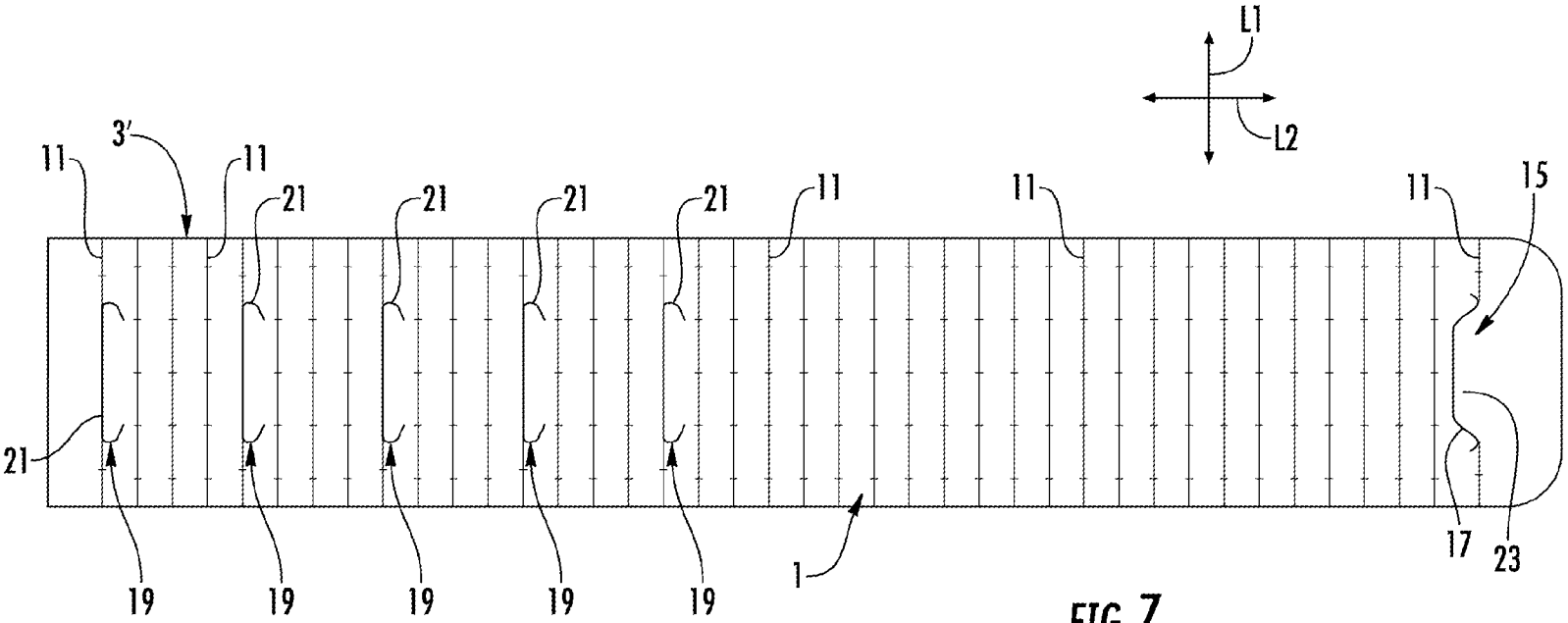
FIG. 7 is a plan view of blank according to an alternative embodiment of the disclosure that is similar to the blank of the first embodiment.

In an alternative embodiment shown in FIG. 7, the blank 3' can be generally similar to the blank 3 of the first embodiment except that the product identification panel 61 and/or the logo can be omitted in the alternative blank 3'. The alternative blank 3' could be otherwise shaped, arranged, positioned, and/or configured without departing from the disclosure.

Figure 8:
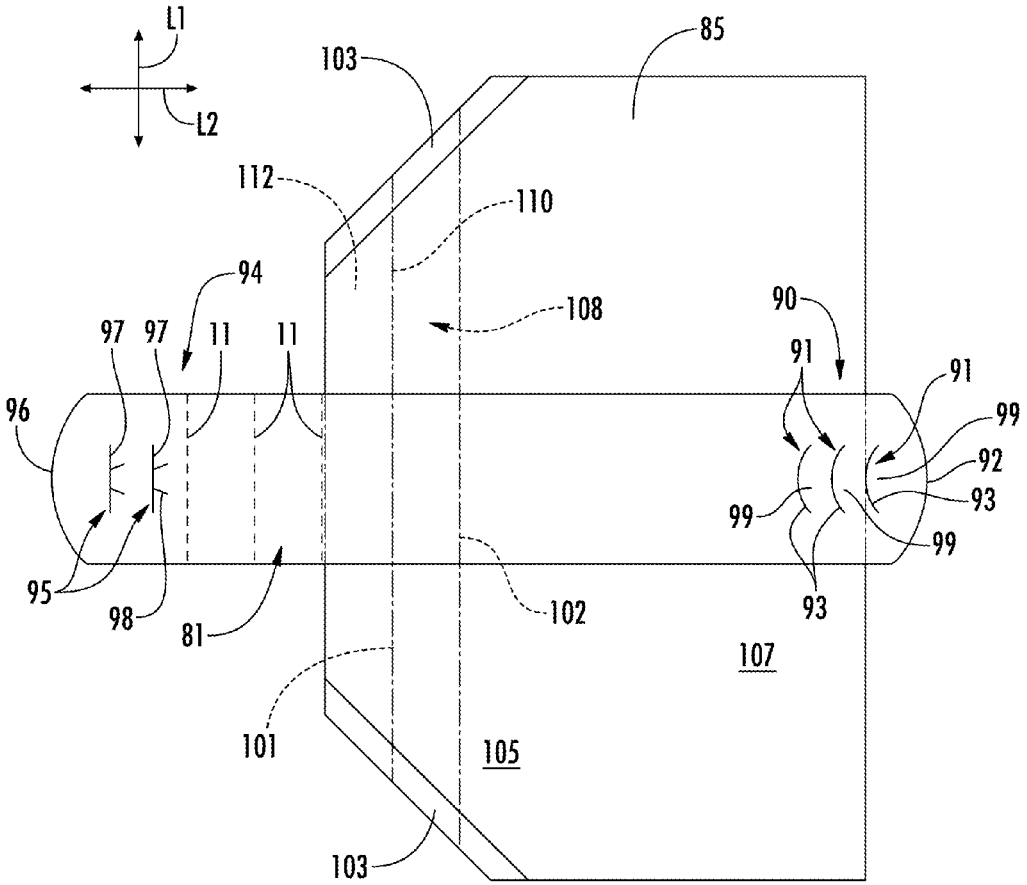
FIG. 8 is a plan view of an exterior of a blank and a liner used to form a package according to a second embodiment of the disclosure.
Figure 13:
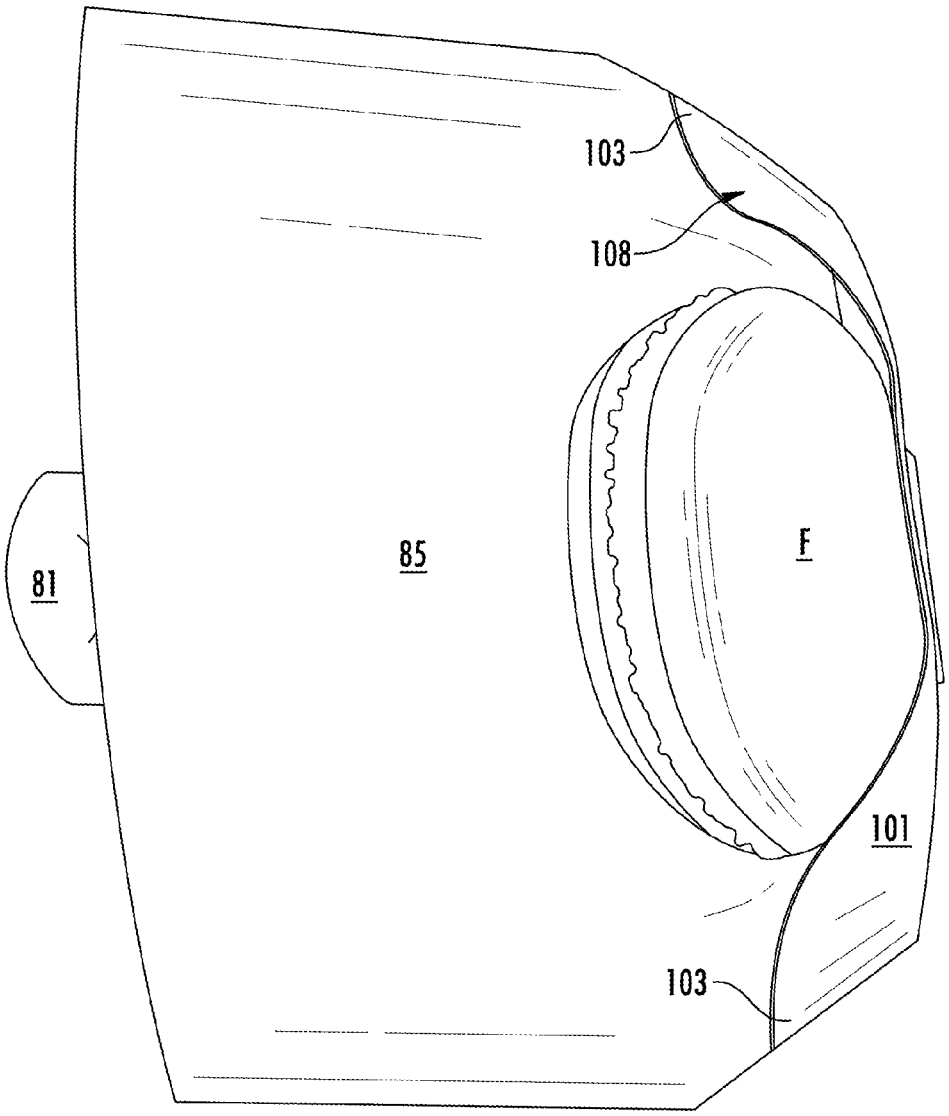
Figure 14:
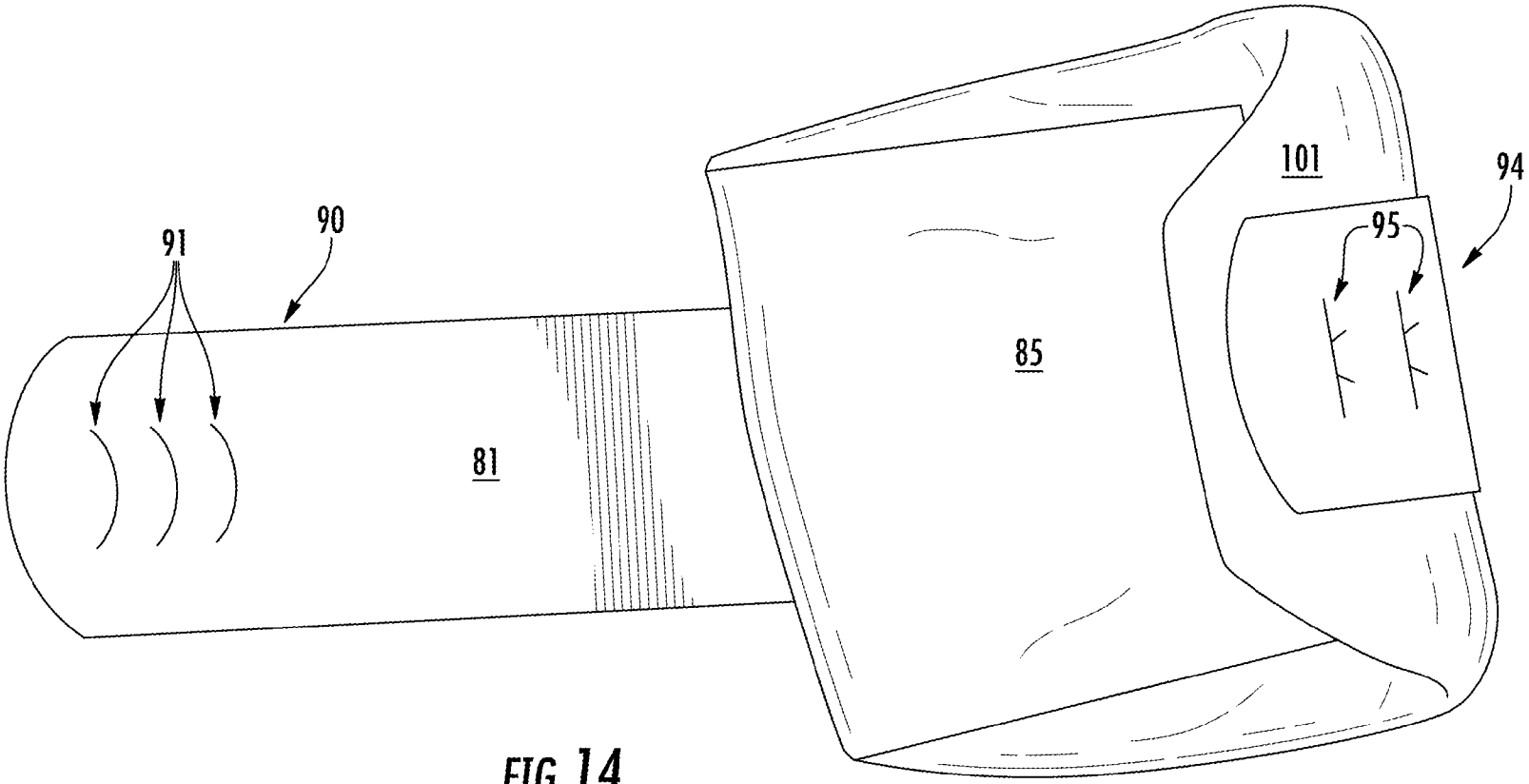
Figure 15:
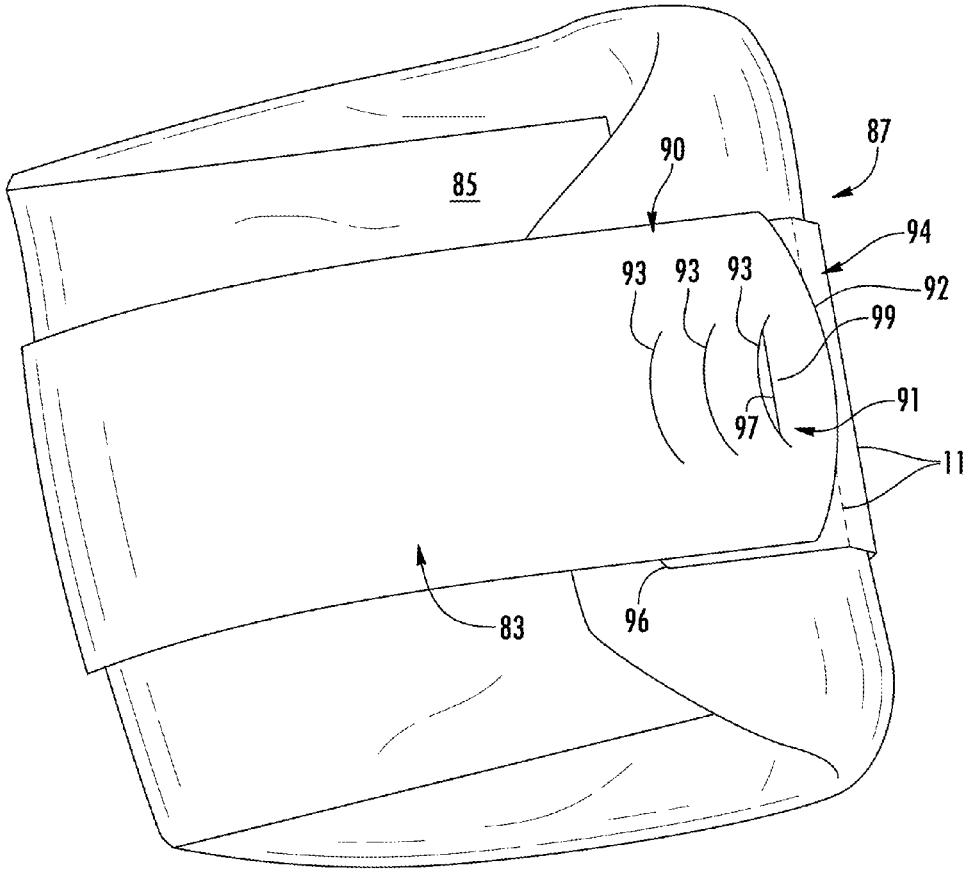
FIG. 15 is a perspective view of the package formed from the blank and the liner of FIG. 8 according to the second embodiment of the disclosure.

FIGS. 8-15 illustrate a second embodiment of a blank 81, construct 83, liner 85, and/or package 87. The package 87 and the other components thereof are similar to the first embodiment of the disclosure and like or similar features are indicated with like or similar reference numbers. As shown in FIG. 8, the blank 81 of the second embodiment includes three lateral fold lines 11, three male locking features 91 that include arcuate cuts 93, and two female locking features 95 that include straight 97 and oblique cuts 98. In one embodiment, the arcuate cuts 93 from male lacking tabs 99 that are for insertion into the female locking features 93 to lock the construct 83 around the food product (FIG. 15). Similarly to the first embodiment, the blank 81 has a first portion 90 that includes the first end 92 of the blank and the male locking features 91 and a second portion 94 that include the second end 96 and the female locking features 95. The blank 81 could be otherwise shaped, arranged, positioned, and/or configured without departing from the disclosure.

Figure 9:
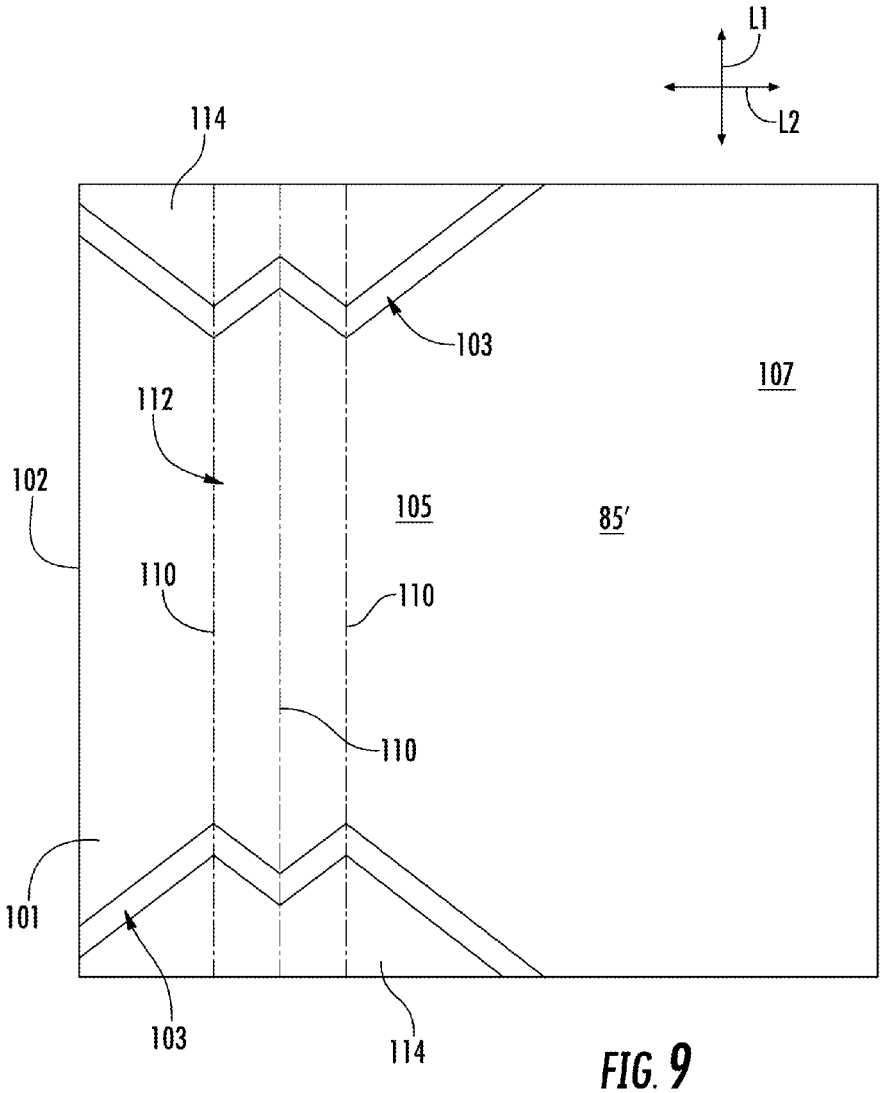
FIG. 9 is a plan view of a preform of the liner of FIG. 8 according to the second embodiment of the disclosure.
Figure 11:
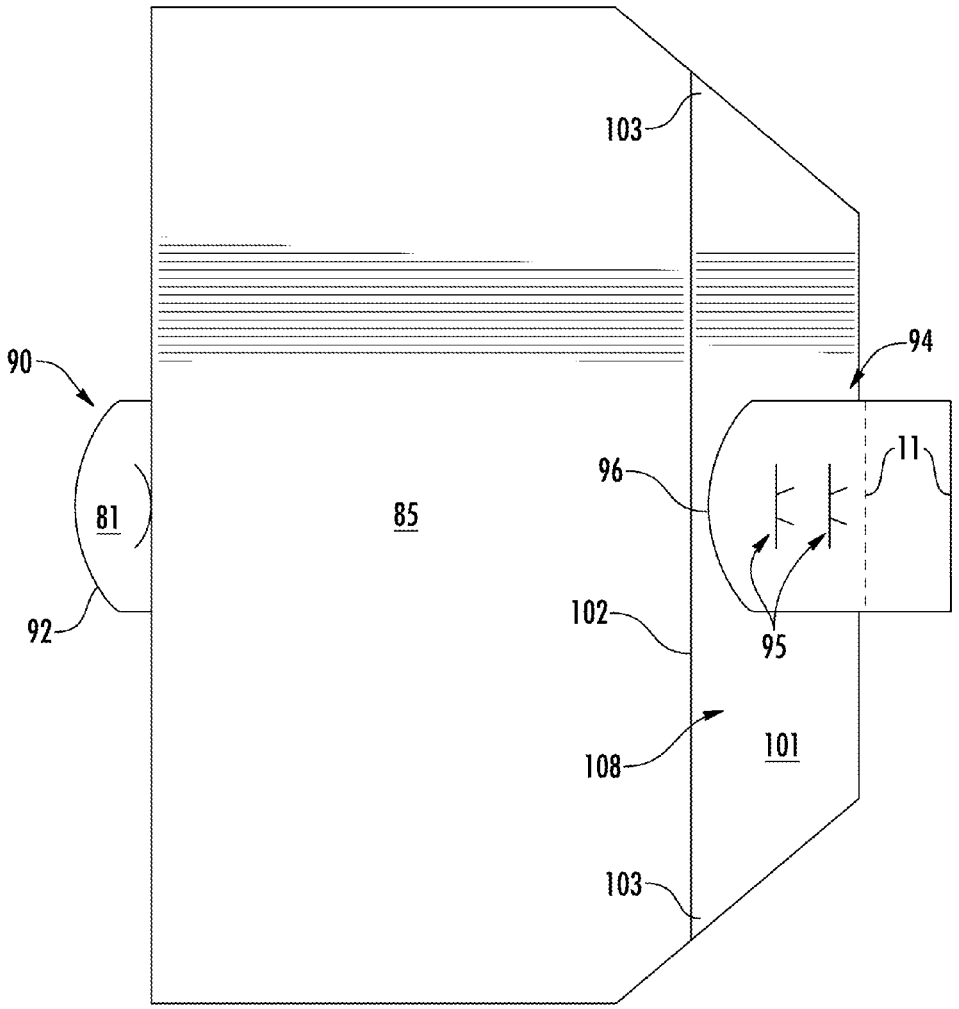
Figure 12:
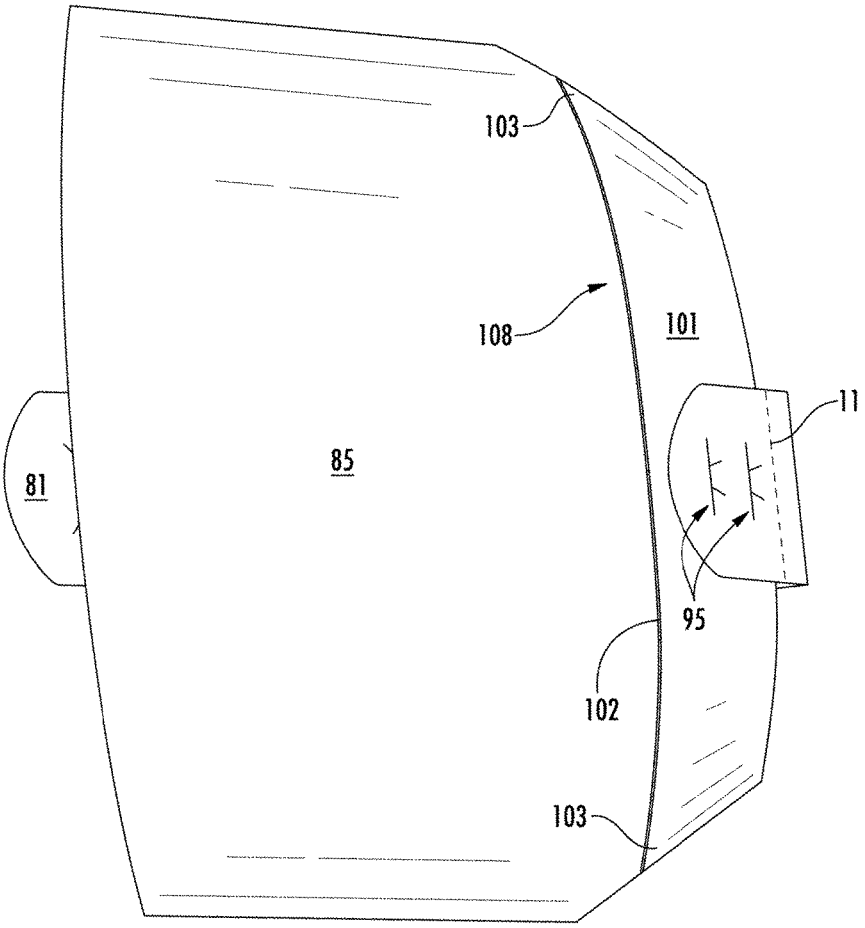

In the illustrated embodiment, the liner 85 can be formed from a preform 85' as shown in FIG. 9. In one embodiment, the preform liner 85' includes corner seals 103 adjacent scrap portions 114. The scrap portions 114 can be removed along the corner seals 103 in order to form the liner 85. Alternatively, the liner 85 could be formed without scrap portions 114. The bottom marginal portion 101 of the liner 85 can be folded at the gusset 112 and the folds 110, which can be similar to the gusset 52 and the folds 50 of the first embodiment, over the central portion 105 to form a pocket or pouch 108 (FIGS. 8 and 11-12). The corner seals 103 can include glue for sealing the ends of the pouch 108, which can be oblique as shown in FIG. 8. As shown in FIG. 8, and in contrast to the first embodiment shown in FIGS. 1-6, the pouch 108, including the bottom edge 102 and the folds 110, extends in the transverse direction L1 with respect to the blank 81. Stated another way, the blank 81 has a length extending in the longitudinal direction L2 from the first end 92 to the second end 96 and a transverse width extending in the lateral direction L1, generally perpendicular to the length, and the pouch 108 is oriented to be generally parallel to the transverse width in the lateral direction L1. The liner 85 could be otherwise shaped, arranged, positioned, and/or configured without departing from the disclosure.

Figure 10:
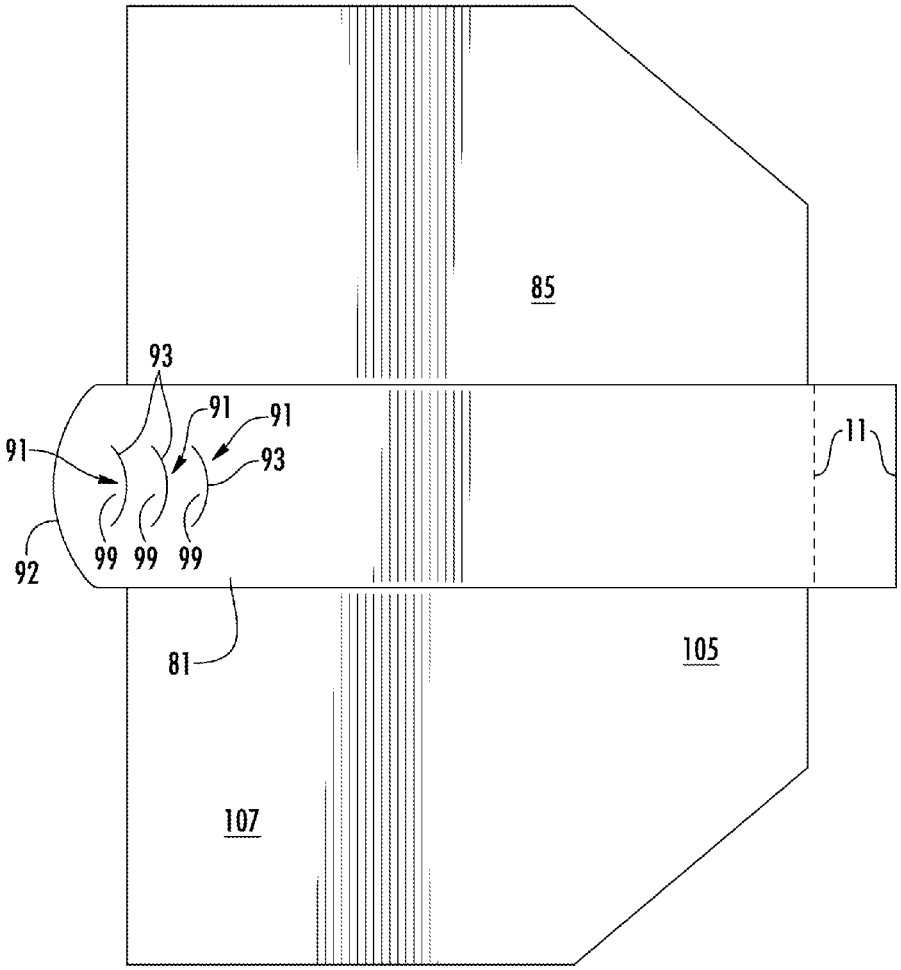
FIGS. 10-14 are views showing the formation of the package from the blank and the liner of FIG. 8 according to the second embodiment of the disclosure.

As shown in FIGS. 10 and 11, the blank 81 can be folded along at least one of the lateral fold lines 11 so that the second portion 94 at least partially overlaps the pouch 108. The pouch 108 can be opened and a food item F can be disposed in the pouch 108 as shown in FIGS. 12 and 13. Subsequently, the end margins of the liner 85 (including the corner seals 103) can be folded over the pocket 108 and the food item F and the top marginal portion 107 can be folded over the pocket 108 and the food item F. Accordingly, the food item F can be enclosed in the liner 85, which is wrapped around the food item as shown in FIG. 14. As shown in FIG. 15, the package 87 can be formed by folding the first portion 90 of the blank 81 upwardly over the liner 85 and the food item F to form the construct 83. In the illustrated embodiment, the construct 83 can be wrapped around the liner 85 and the food item F so that the first portion 90 overlaps the second portion 94. Additionally, as shown in FIG. 15, one or more of the male locking tabs 99 can engage with one or more respective female locking elements 95 to help retain the construct 83 and the liner 85 in the wrapped configuration. The package 87 could be otherwise formed without departing from the disclosure. Additionally, the first portion 90 and the second portion 94 of the construct 83 can be otherwise engaged and/or secured to one another. For example, in addition or alternatively to the male locking feature 91 and the female locking features 95, the first portion 90 and the second portion 94 could be secured together by an adhesive (e.g., an adhesive sticker, retack glue, and/or tape) or any other suitable securing method. In one embodiment, an adhesive sticker and/or any other suitable securing method could be applied to the liner 85 to secure portions of the liner to one another and/or to the construct 83.

Figure 16:
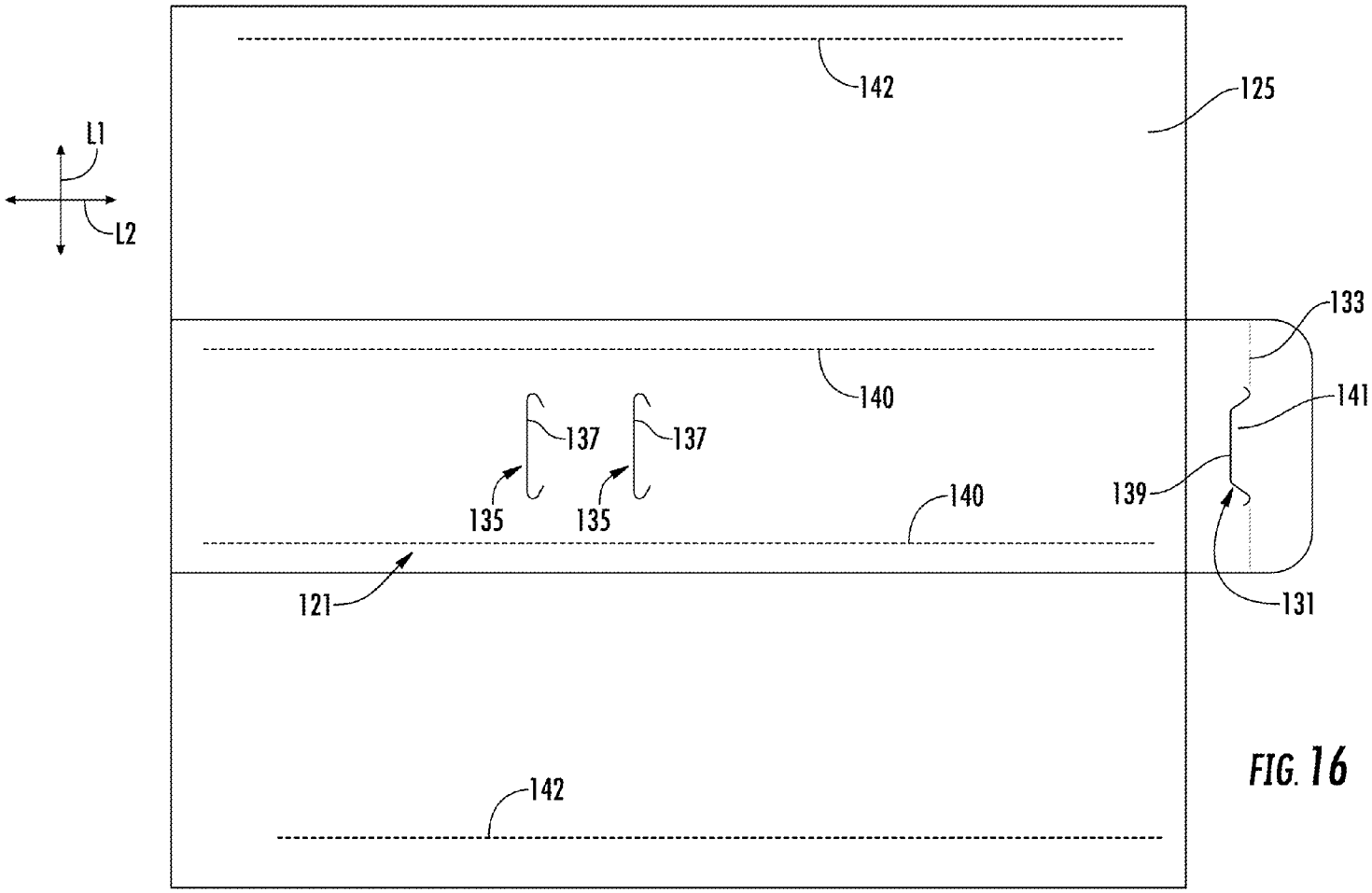
FIG. 16 is a plan view of an exterior of a blank and a liner used to form a package according to a third embodiment of the disclosure.

FIGS. 16-20 illustrate a third embodiment of a blank 121, construct 123, liner 125, and/or package 127. The package 127 and the other components thereof are similar to the previous embodiments of the disclosure and like or similar features are indicated with like or similar reference numbers. As shown in FIG. 16, the blank 121 includes a single male locking feature 131 adjacent a lateral fold line 133, and two female locking features 135 formed by cuts 137. The male locking feature 131 is formed by a cut 139 and comprises a male locking tab 141. The blank 121 could be otherwise shaped, arranged, positioned, and/or configured without departing from the disclosure. For example, the blank 121 could include any suitable number of male locking features 131 and/or female locking features 135.

In the illustrated embodiment, the liner 125 is attached to the blank 121 by glue lines 140 extending in the longitudinal direction L2. Additionally, longitudinal glue lines 142 extend in the marginal end portions of the liner 125. The liner 125 could be otherwise shaped, arranged, positioned, and/or configured without departing from the disclosure.

Figure 17:
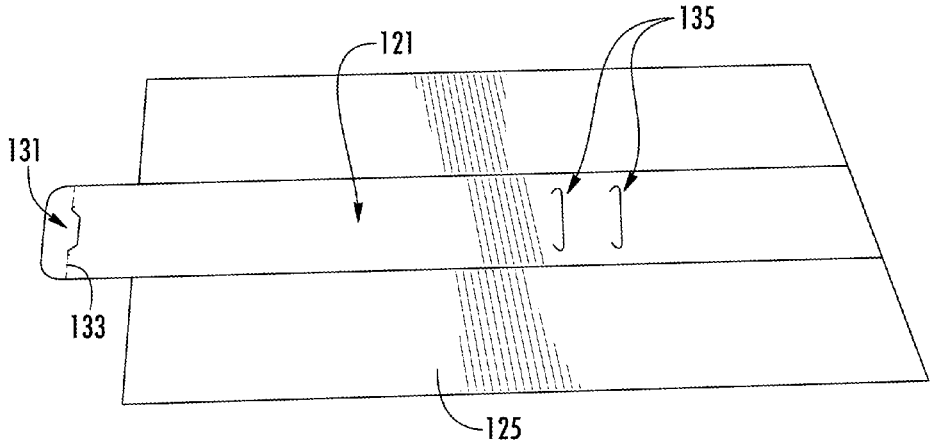
FIGS. 17-19 are perspective views showing the formation of the package from the blank and the liner of FIG. 16 according to the third embodiment of the disclosure.
Figure 18:
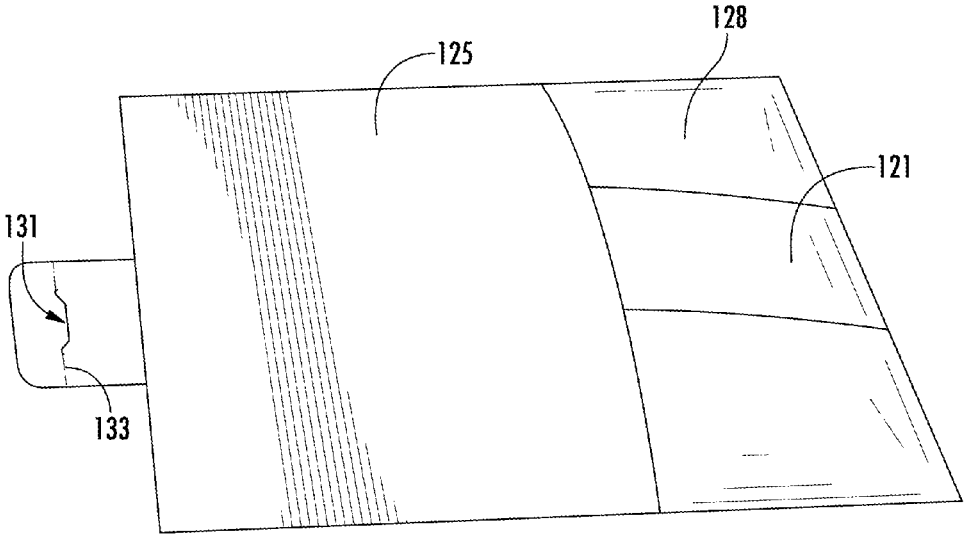
Figure 19:
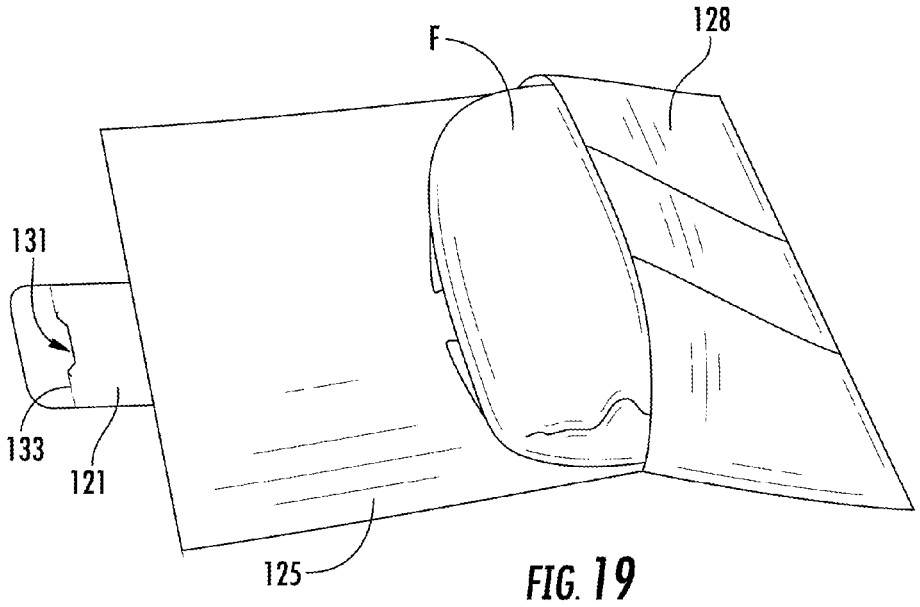
Figure 20:
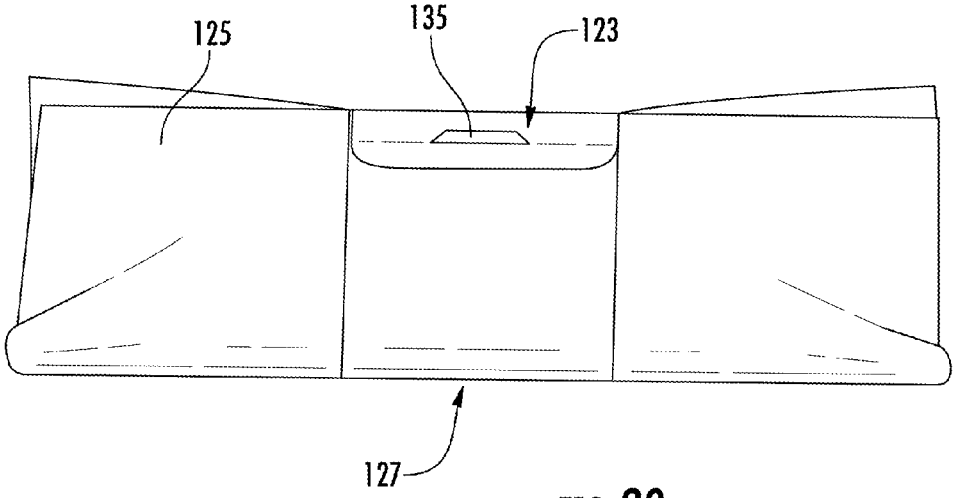
FIG. 20 is a perspective view of the package formed from the blank and the liner of FIG. 16 according to the third embodiment of the disclosure.

As shown in FIGS. 17 and 18, the blank 121 and the liner 125 can be folded over to form the pouch 128 and a food item F (e.g., a burrito) can be positioned into the pouch 128 as shown in FIG. 19. The remainder of the blank 121 and the liner 125 can be folded over the pouch 128 and the food item F to form the package 127 as shown in FIG. 20. In one embodiment, the overlapping portions of the liner 125 can be glued to one another along the glue strips 142. As shown in FIG. 20, the blank 121 is formed into the construct 123 by overlapping the first and second portions of the construct 123 and interlocking the male locking feature 131 with a selected one of the female locking features 135 similarly to the first embodiment. In the embodiment of FIG. 20, the size and tightness of the construct 123 around the food product F can be varied by selection of the desired female locking feature 135. The package 127 could be formed by other steps and could have other features without departing from the disclosure. Additionally, the first and second portions of the construct 123 can be otherwise engaged and/or secured to one another. For example, in addition or alternatively to the male locking feature 131 and the female locking features 135, the first and second portions could be secured together by an adhesive (e.g., an adhesive sticker, retack glue, and/or tape) or any other suitable securing method. In one embodiment, an adhesive sticker and/or any other suitable securing method could be applied to the liner 125 to secure portions of the liner to one another and/or to the construct 123.

Figure 21:
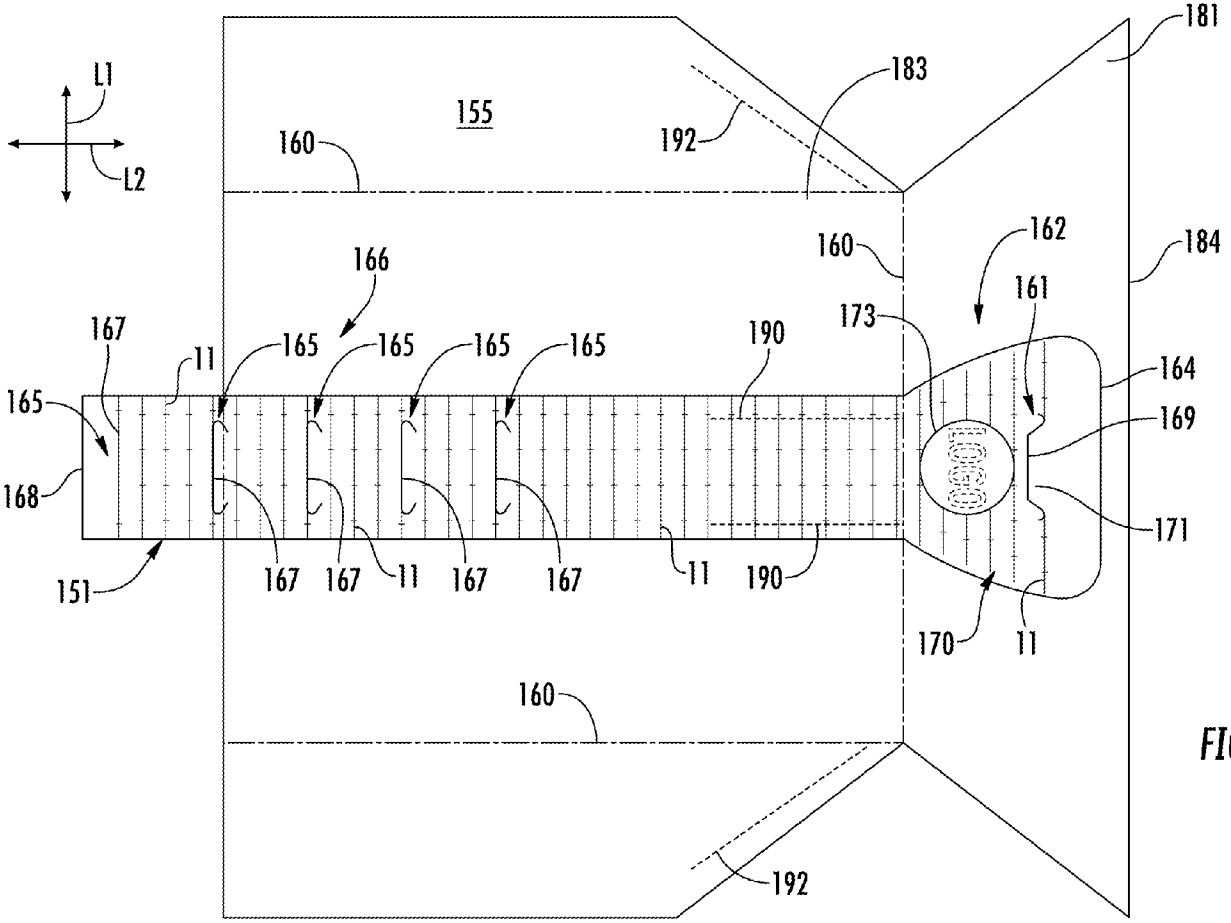
FIG. 21 is a plan view of an exterior of a blank and a liner used to form a package according to a fourth embodiment of the disclosure.

FIGS. 21-24 illustrate a fourth embodiment of a blank 151, construct 153, liner 155, and/or package 157. The package 157 and the other components thereof are similar to the previous embodiments of the disclosure and like or similar features are indicated with like or similar reference numbers. As shown in FIG. 21, the blank 151 includes a single male locking feature 161, a plurality of lateral fold lines 11, and five female locking features 165 formed by cuts 167. The male locking feature is formed by a cut 169 and comprises a male locking tab 171. In the illustrated embodiment, the male locking features 161 and the female locking features 165 are generally similar to or the same as the respective male locking features 15 and female locking features 19 of the first embodiment (FIG. 1). The blank 151 includes a base portion 170 comprising the male locking feature 161 and a product identification panel 173 (e.g., with a suitable logo). The product identification panel 173 could be otherwise located on the blank 151 without departing from the disclosure. The blank 151 can include a first portion 162 adjacent the first end 164 and a second portion 166 adjacent the second end 168 so that the first portion 162 and the second portion 166 are generally spaced from one another along the longitudinal length of the blank 151. As shown in FIG. 21, the first portion 162 can include at least the male locking feature 161 and the base portion 170, and the second portion 166 can include the female locking features 165. The blank 151 and/or the construct 153 could be otherwise shaped, arranged, and/or configured without departing from the disclosure.

Figure 22:
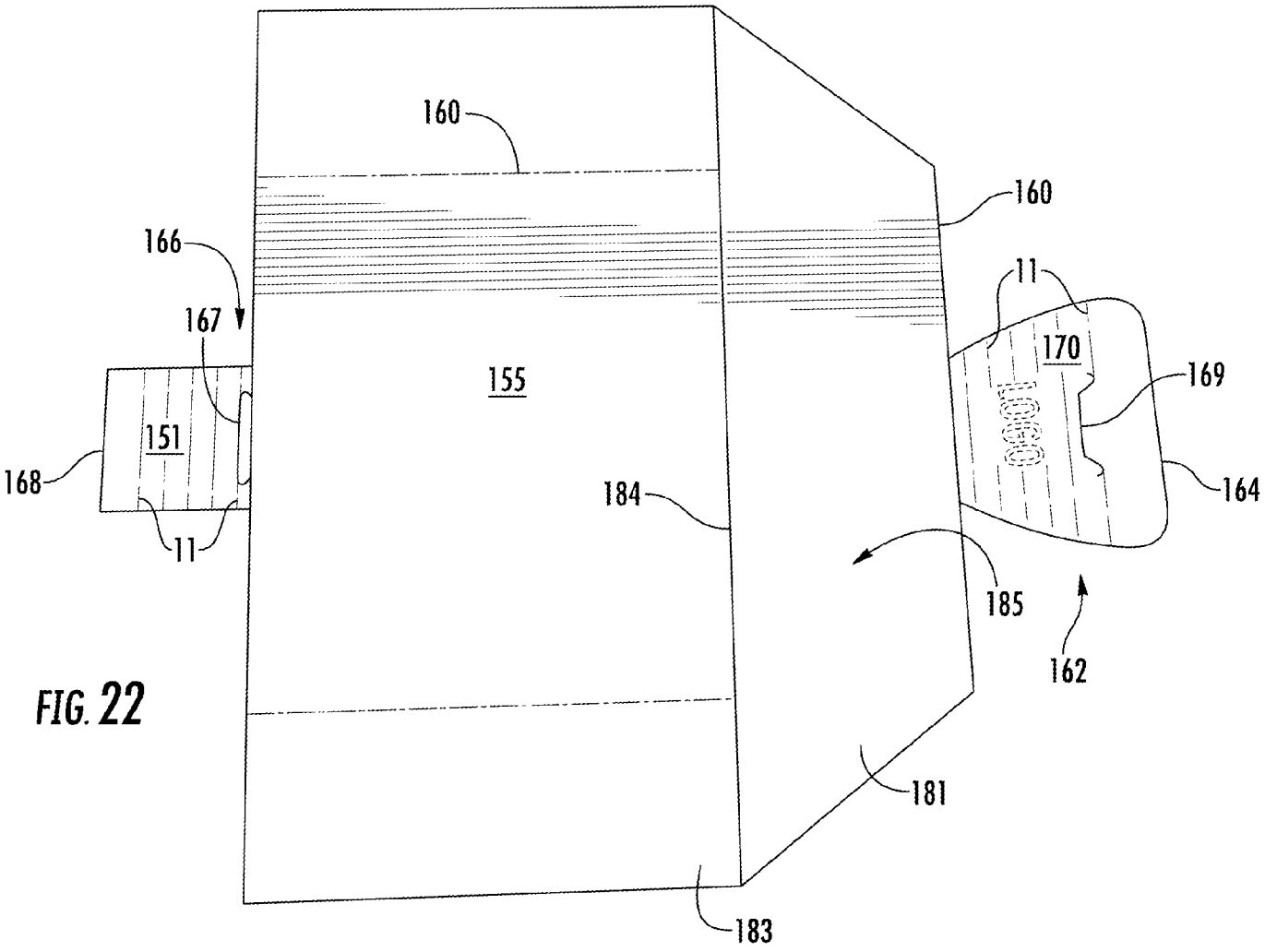
FIGS. 22 and 23 are perspective views showing the formation of the package from the blank and the liner of FIG. 21 according to the fourth embodiment of the disclosure.
Figure 23:
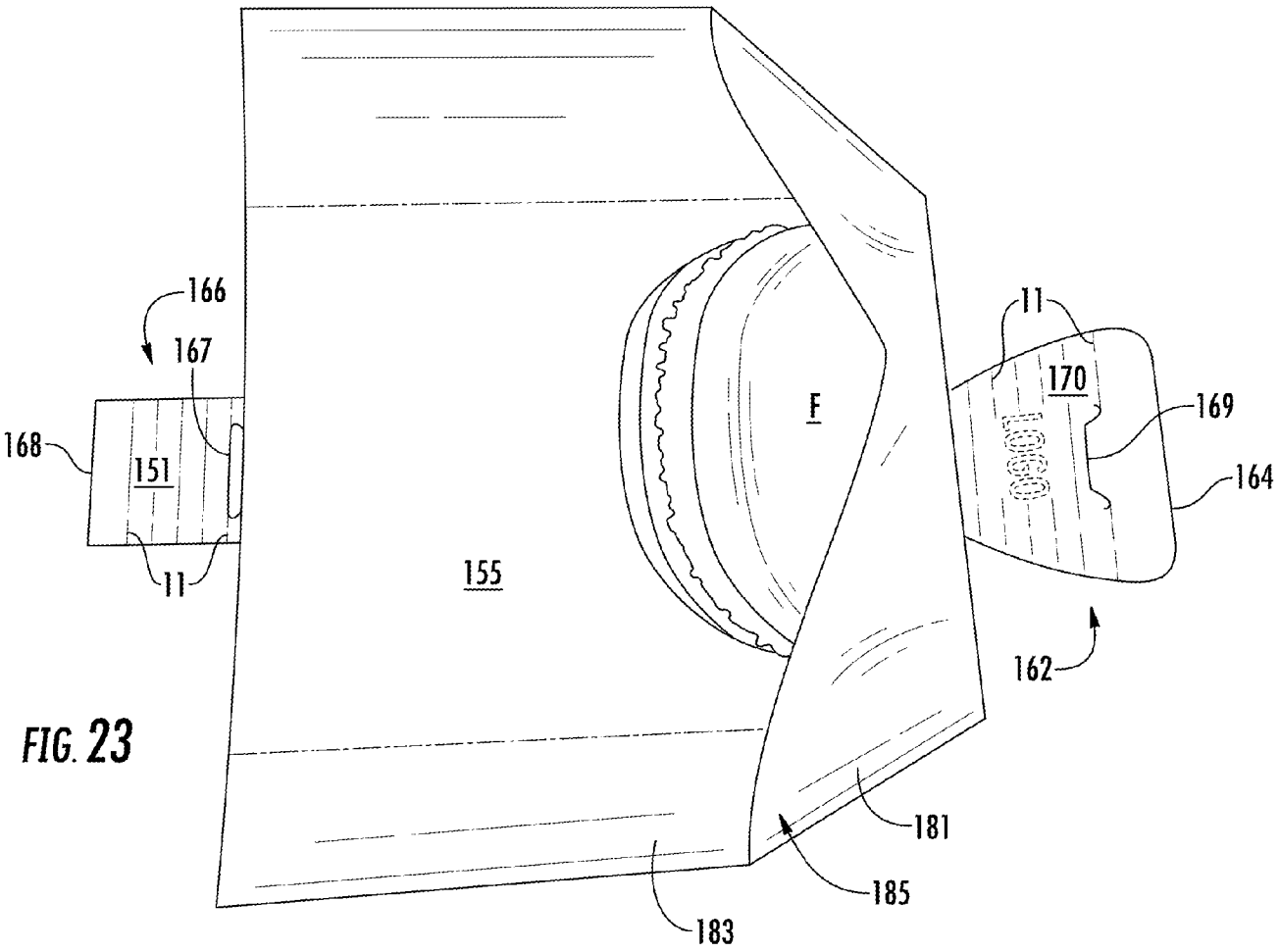

The liner 155 includes a flap portion or bottom marginal portion 181 that is glued (e.g., along glue lines 192) to a central portion 183 of the liner to form a pocket or pouch 185 (FIGS. 22 and 23). In the illustrated embodiment, the bottom marginal portion 181 is connected to the central portion 183 along a fold 160 extending in the lateral direction L1, and two cutouts are formed adjacent the central portion 183 and the bottom marginal portion 181 so that the end portions of the pouch 185 are oblique (FIG. 22). The liner 155 also can include longitudinal folds 160 that can facilitate folding of the liner around the food item. In one embodiment, the liner 155 can be attached to the blank 151 by two longitudinal glue lines 190 so that the bottom marginal portion 181 and the pouch 185 are disposed adjacent to the first portion 162 and the male locking features 161. In contrast, in the embodiments shown in FIGS. 8-20, the pouch is disposed adjacent to the second end of the respective blank adjacent the female locking features. The liner 155 could be otherwise shaped, arranged, positioned, and/or configured without departing from the disclosure.

Figure 24:
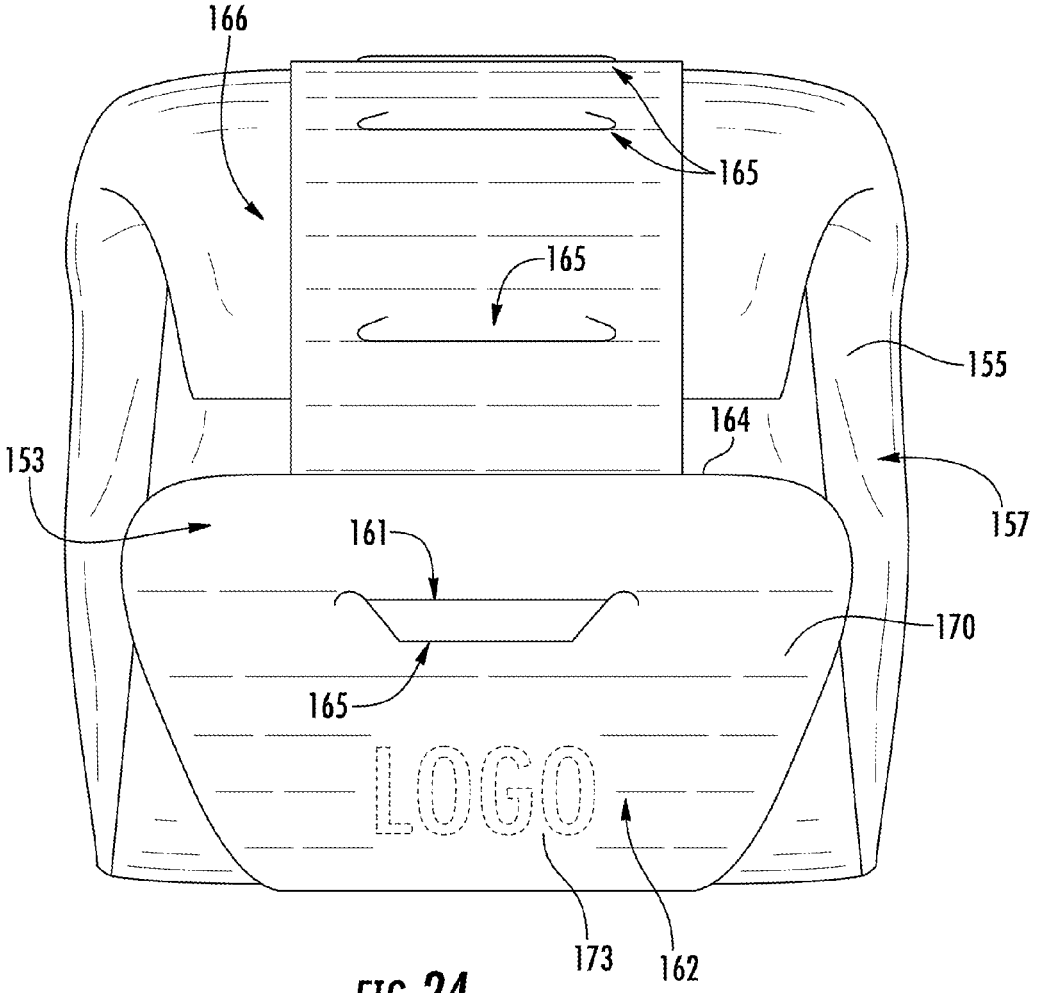
FIG. 24 is a perspective view of the package formed from the liner and the blank of FIG. 21 according to the fourth embodiment of the disclosure.

As shown in FIGS. 22-24, the blank 151 and the liner 155 can be wrapped around the food product F to form the package 157 with the construct 153 in a similar manner as the previous embodiments. The food product F can be received in the pocket 185 formed in the liner 155 (FIG. 23) and wrapped in the liner and secured in the construct 153 upon locking of the male locking feature 161 in the female locking feature 165. The size and tightness of the construct 153 around the food product F can be varied by selection of the desired female locking feature 165. The package 157 could be formed by other steps and could have other features without departing from the disclosure. Additionally, the first portion 162 and the second portion 166 of the construct 153 can be otherwise engaged and/or secured to one another. For example, in addition or alternatively to the male locking feature 161 and the female locking features 165, the first portion 162 and the second portion 166 could be secured together by an adhesive (e.g., an adhesive sticker, retack glue, and/or tape) or any other suitable securing method. In one embodiment, an adhesive sticker and/or any other suitable securing method could be applied to the liner 155 to secure portions of the liner to one another and/or to the construct 153.

Figure 25:
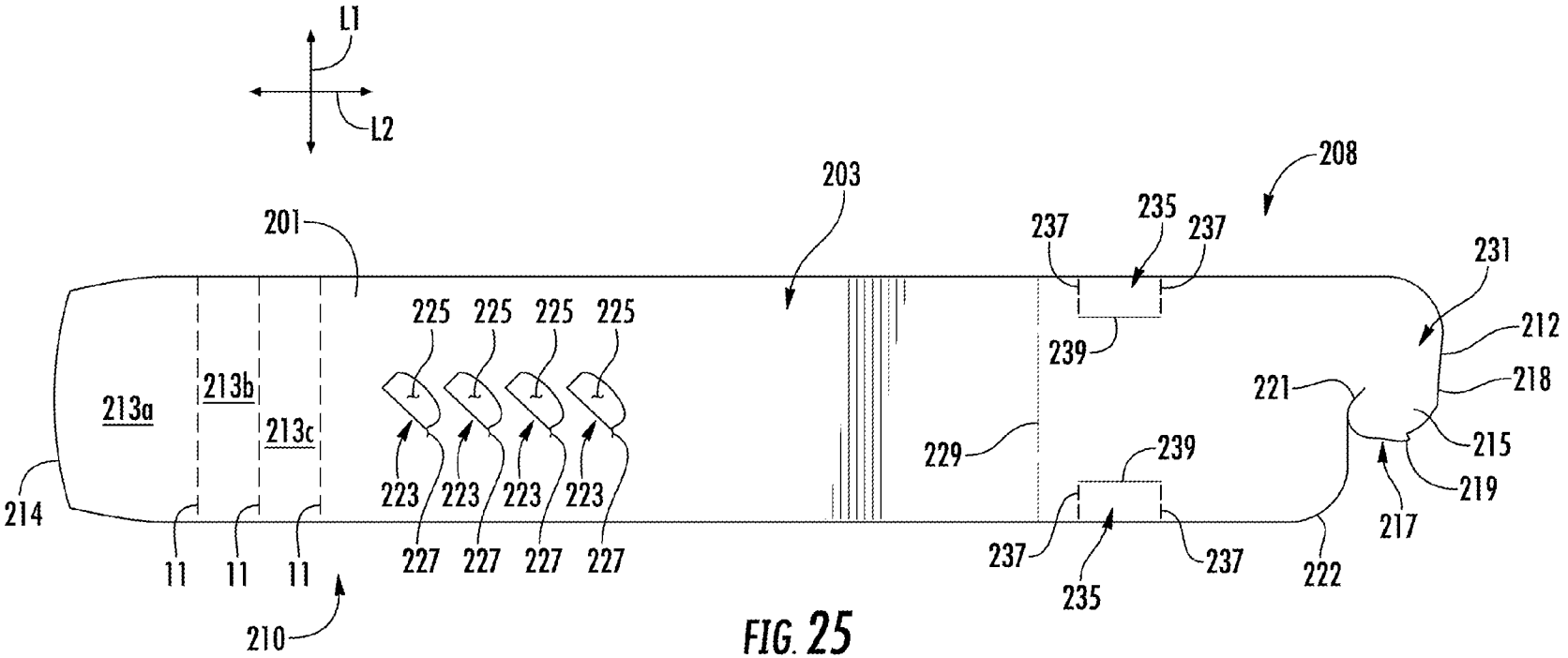
FIG. 25 is a plan view of an exterior side of a blank used to form a construct according to a fifth embodiment of the disclosure

FIGS. 25-37 illustrate a fifth embodiment of a blank 203, construct 209, liner 205, and/or package 207. The package 207 and the other components thereof are similar to the previous embodiments of the disclosure and like or similar features are indicated with like or similar reference numbers. As shown in FIG. 25, the blank 203 includes a first portion 208 at a first end 212 and a second portion 210 proximate to a second end 214. A plurality of lateral fold lines 11 can extend across the width of the blank 203 at the second portion 210 generally near the second longitudinal end 214 of the blank. The fold lines 11 can form independently moveable panels 213*a*, 213*b*, 213*c* in the second portion 210 of the blank 203. Another lateral fold line 229 can extend adjacent the first portion 208 of the blank. As shown in FIG. 25, the blank 203 includes a male locking feature 215 at the first longitudinal end 212 of the blank. In one embodiment, the male locking feature 215 has a generally curved edge 217 with a protrusion 219 extending from the curved edge. The curved edge 217 extends from a lateral edge 218 at the first longitudinal end 212 to a curved cut 21 that extends from a generally curved edge 222 of the blank 203. In one embodiment, the cut 221 and the curved edge 217 can form a generally V-shaped notch near the longitudinal end 212 that forms a male locking tab 231 of the male locking feature 215. In the illustrated embodiment, the second portion 210 of the blank 203 can include a plurality of female locking features 223 that can be openings 225 having curved cuts 227 at respective corners of the openings. As shown in FIGS. 25, 29, and 37, the plurality of female locking features 223 is spaced apart from the second end 214 by at least the panels 213*a*, 213*b*., 213*c*. The male locking tab 231 can be shaped for being received in a selected one of the opening 225 of a respective female locking feature 223 and engaging the respective cut 227 so that the male locking tab interlocks with the respective female locking opening 225.

Figure 26:
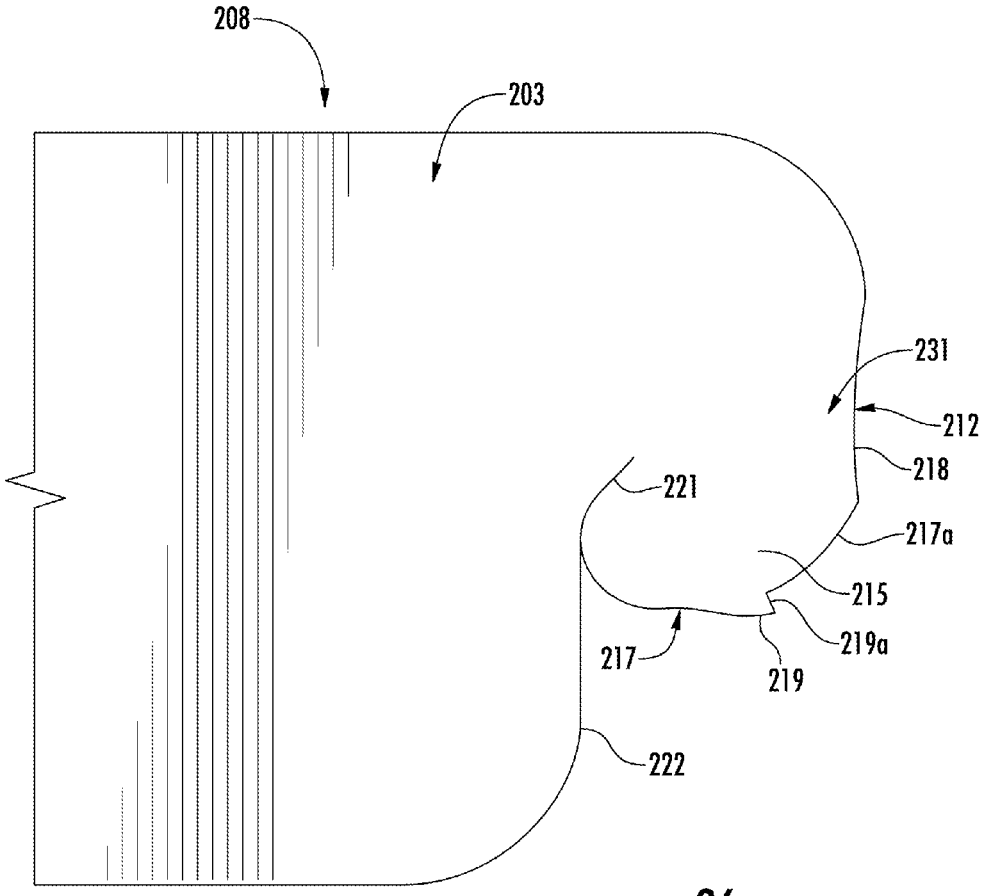
FIGS. 26 and 27 are detail views of the blank of FIG. 25.

FIG. 26 shows a detail view of the first portion 208 of the blank 203 with the male locking tab 231 of the male locking feature 215. As shown in FIG. 26, the protrusion 219 extending from the curved edge 217 includes a generally straight edge 219*a* extending from a first segment 217*a* of the curved edge 217. The first segment 271*a* extends from the lateral edge 218 forming the longitudinal end 212 of the blank 203. The male locking tab 215 could have other features and could be otherwise shaped, arranged, configured, and/or positioned without departing from the disclosure.

Figure 27:
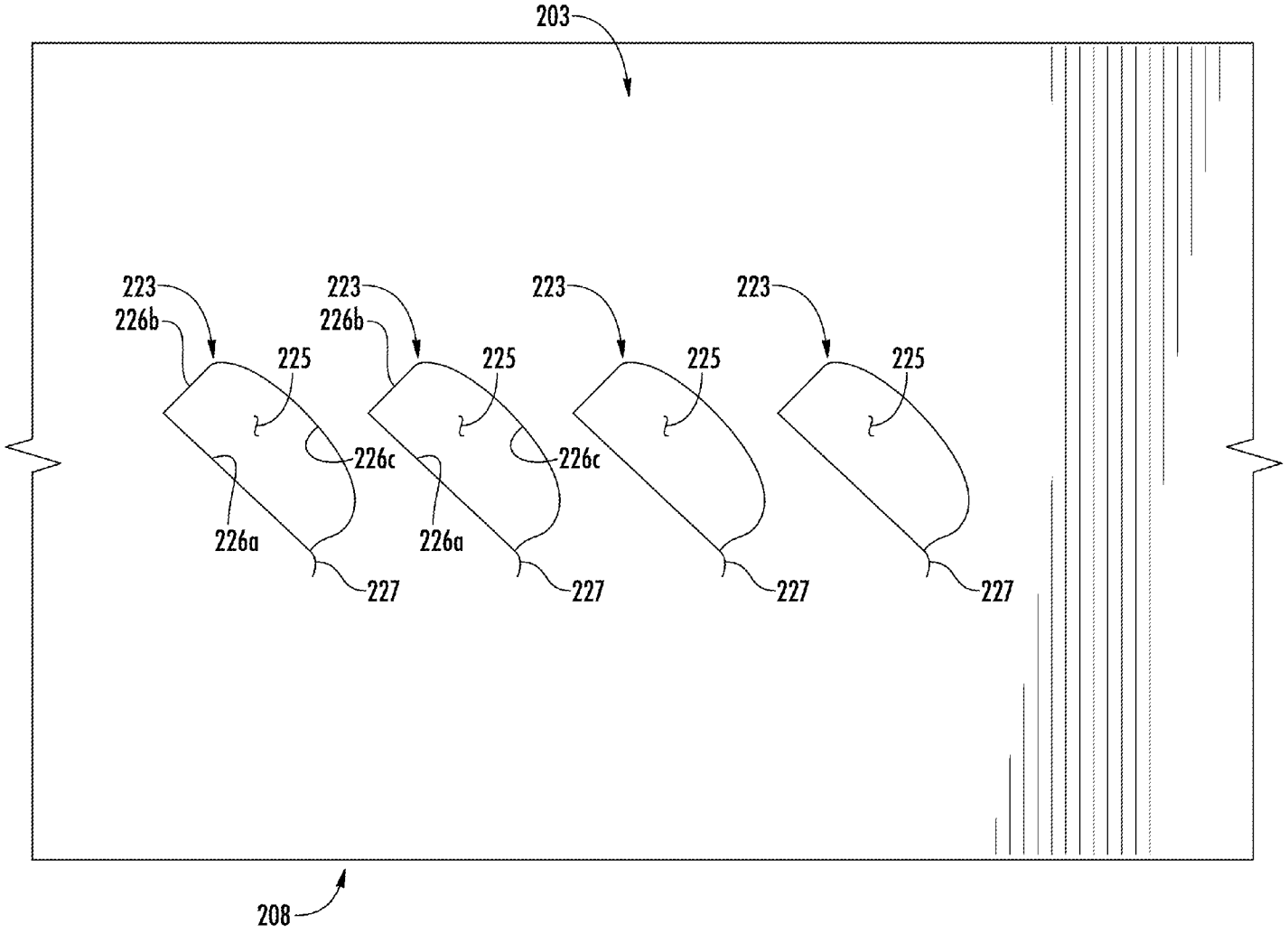

FIG. 27 shows an enlarged portion of the blank 203 including the female locking openings 225 of the female locking features 223. As shown in FIG. 27, each opening 225 of the female locking features 223 is formed by a first generally straight edge 226*a* (e.g., a locking edge), a second generally straight edge 226*b* that is generally perpendicular to the first straight edge, and a curved edge 26*c* extending from the second straight edge to the cut 227 that is at a respective corner of the opening. The cut 227 is located at the convergences of the locking edge 226*a* and the curved edge 226*c*. In the illustrated embodiment, the curved edge 226*c* has a first portion extending generally away in a transverse direction from the second generally straight edge 226*b* and a second portion extending from the first portion, generally downwardly, to the cut 227. In one embodiment, the second portion of the curved edge 226*c* has a smaller radius of curvature than the first portion of the curved edge 226*c*. The opening 225 is generally shaped by the edges 226*a*, 226*b*, 226*c* and cut 227 to facilitate receiving the male locking tab 231 so that the construct remains locked and secured around the food product F. The shape of the cut 227 at the corner of the opening 225 allows the straight edge 219*a* of the protrusion 219 of the male locking tab 231 to catch and prevent premature withdrawal of the male locking tab from the female locking opening. The female locking feature 223 and the female locking opening 225 could be otherwise shaped, arranged, positioned, and/or configured without departing from the disclosure.

In one embodiment, the blank 203 includes opposing indicator tabs 235 that are defined by a respective pair of lateral cuts 237 that extend from a respective longitudinal fold line 239. In one embodiment, the cuts 237 can include nicks, but the cuts could be other lines of weakening (e.g., tear lines, etc.) to allow the indicator tabs 235 to be folded relative to the blank 203 without departing from the disclosure. In an exemplary embodiment, the indicator tabs 235 can be used (e.g., folded with respect to the remainder of the blank 203) to differentiate the food item F contained in the package 207 between a number of options (e.g., a chicken sandwich versus a cheeseburger). The indicator tabs 235 could be otherwise shaped, arranged, positioned, and/or configured without departing from the disclosure.

Figure 28:
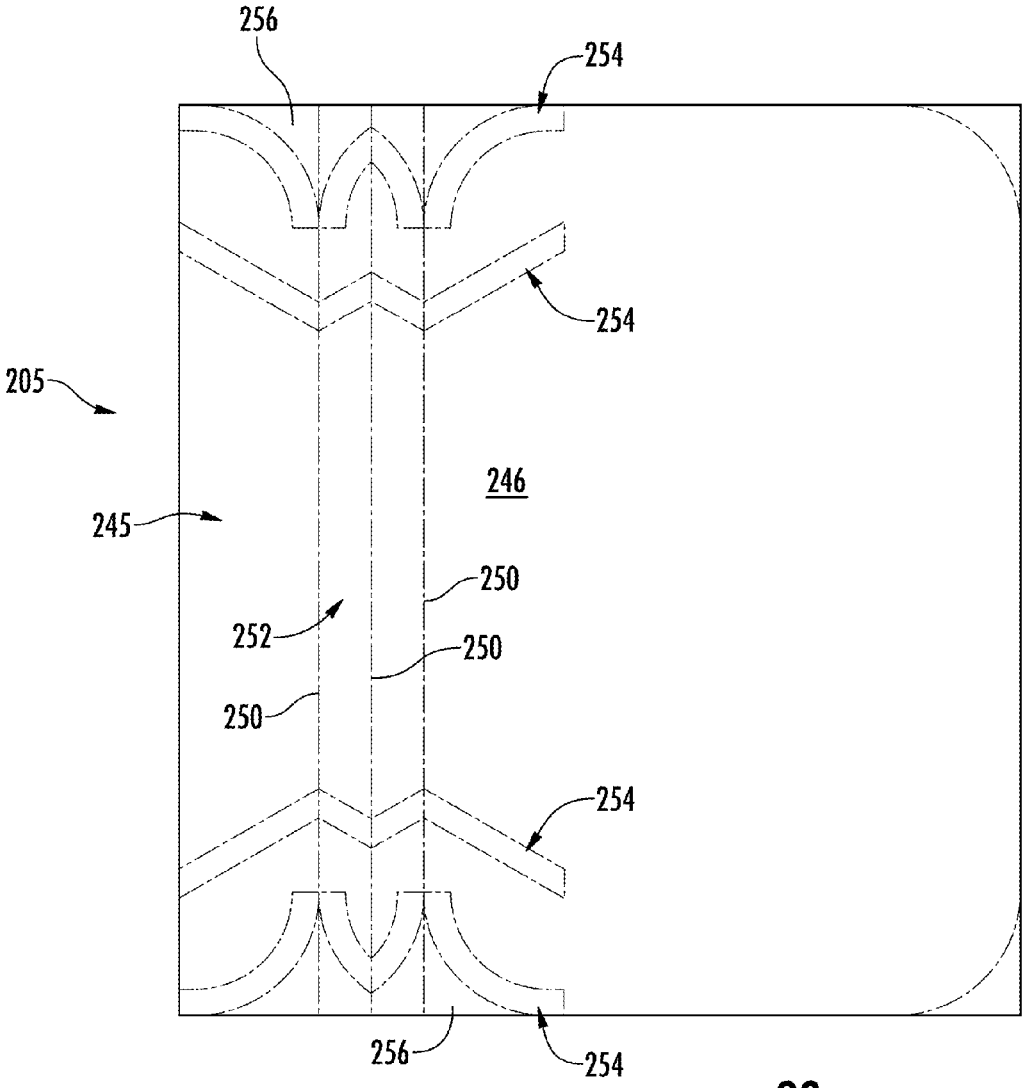
FIG. 28 is a plan view of a preform of a liner for forming a package with the blank of FIG. 25 according to the fifth embodiment of the disclosure.
Figure 29:
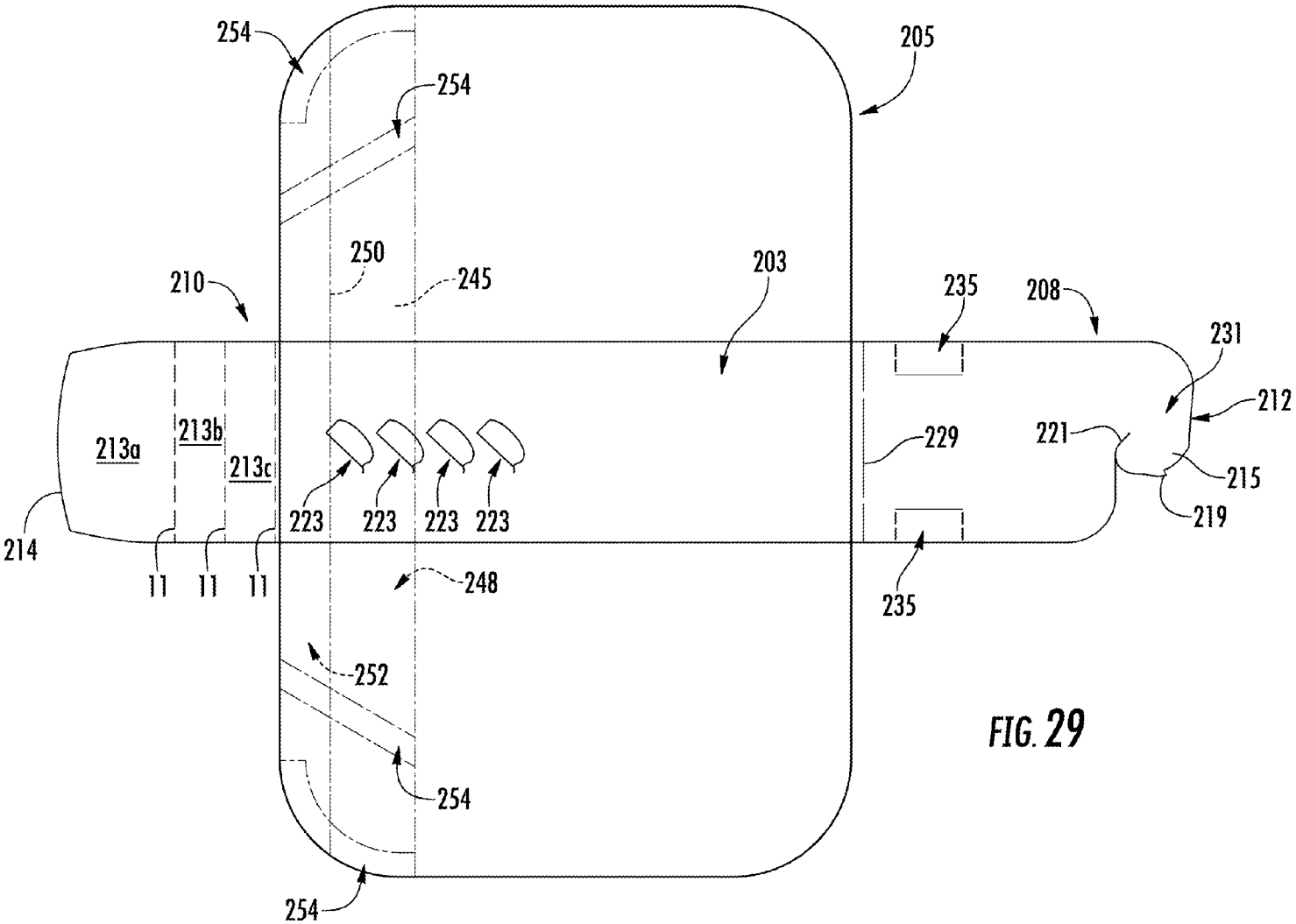
FIG. 29 is an exterior view of the blank of FIG. 25 and the liner formed from the preform of FIG. 28.

As shown in FIG. 28, the liner 205 can include a bottom marginal portion 245 connected to a central portion 246 by a gusset 252 with folds 250. The gusset 252 can be similar to the gusset 52 of the first embodiment. Scrap portions 256 can be removed from the gusset 252, the bottom marginal portion 245, and the central portion 256 so that the pouch 248 (FIGS. 29, 30, and 32) has rounded corners. Additional scrap portions can be removed at the opposing corners of the top marginal portion so that the top marginal portion also has rounded corners. As shown in FIG. 28, the liner 205 can include seal features 254, which can include glue, for example, for at least partially sealing the end portions of the pouch 248. The liner 205 could be otherwise shaped, arranged, positioned, and/or configured without departing from the disclosure. For example, one or more of the seal features 254 could be omitted.

Figure 30:
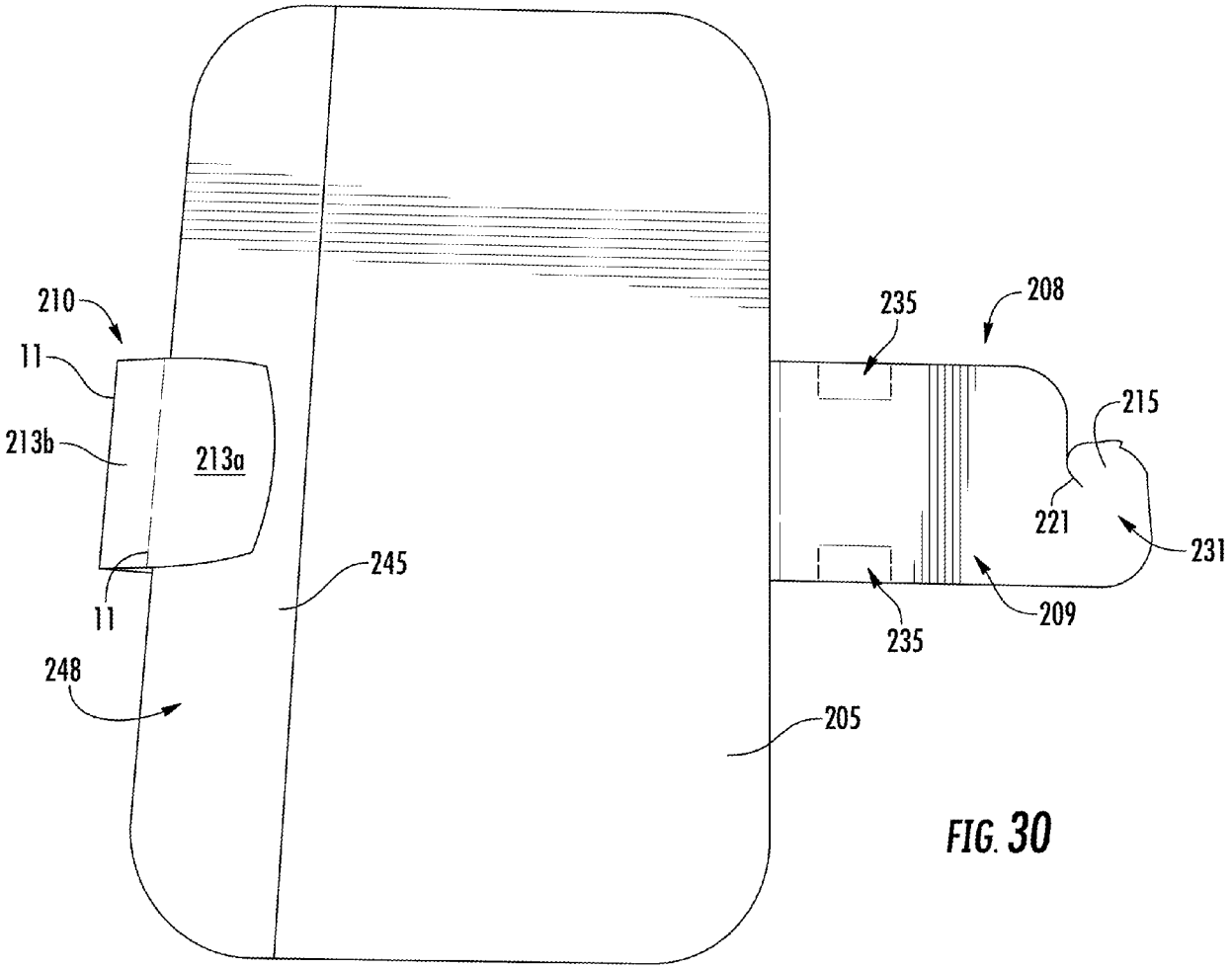
FIGS. 30-33 are perspective views showing the formation of the package from the blank and the liner of FIG. 29 according to the fifth embodiment of the disclosure.
Figure 31:
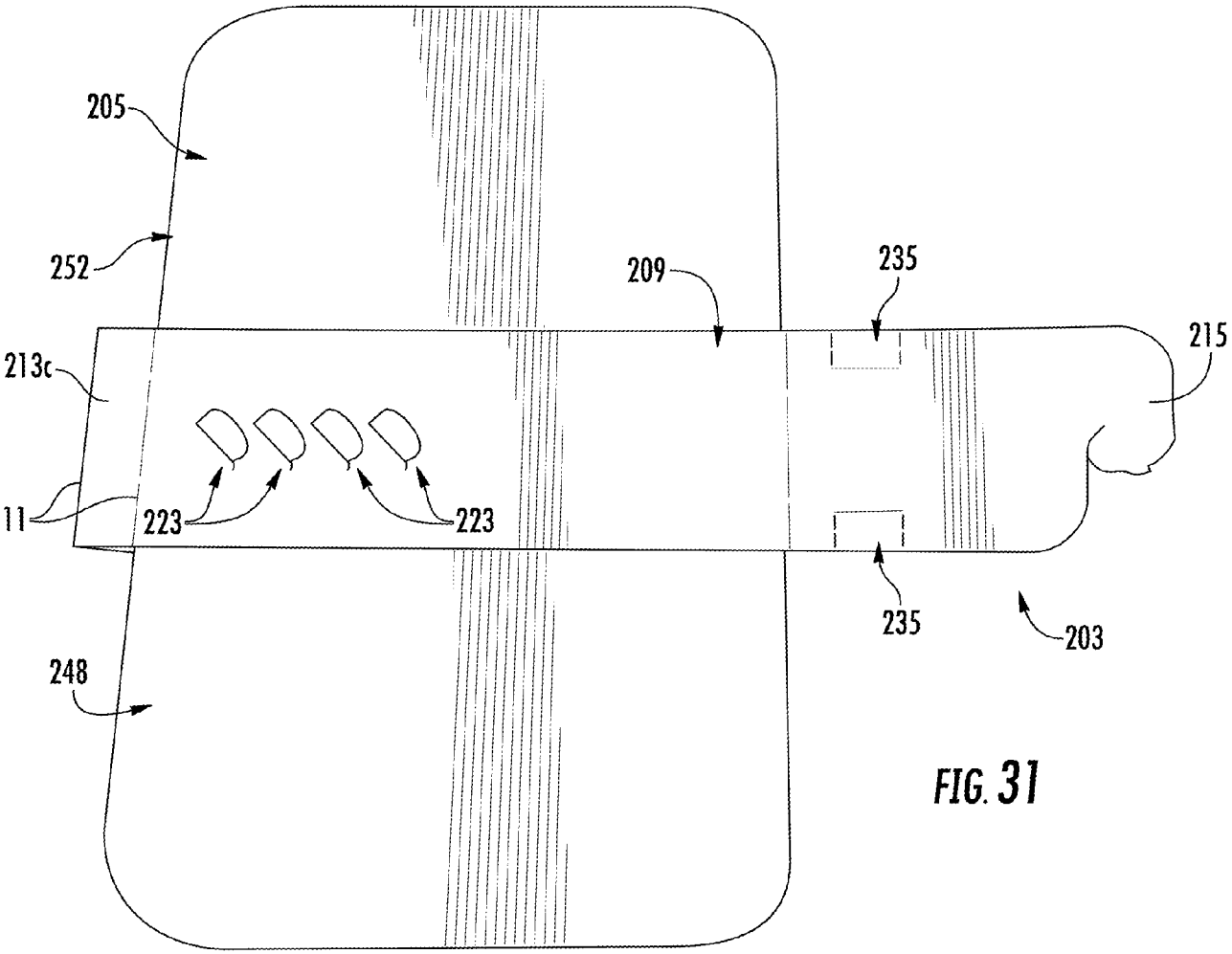

As shown in FIG. 29, the bottom marginal portion 245 can be folded over via the gusset 252 and adhered to the central portion 246 at the seal features 254 to form the pouch 248. Additionally, the liner 205 can be glued to the blank 203. In the illustrated embodiment, the pouch 248 is oriented to be generally transverse to the longitudinal length of the blank 203 (e.g., along the width of the blank) and disposed on the second portion 210 adjacent the panel 213*c*. As shown in FIGS. 30 and 31, the blank 203 can be folded along one or more of the transverse fold lines 11 so that one or more of the panels 213*a*, 213*b*, 213*c* overlaps the pouch 248 for reinforcing the pouch in the interior of the package 207. In one embodiment, the panels 213*a*, 213*b*, 213*c* serve as a convenient place to hold the food item F when the package is partially unwrapped for consuming the food item.

Figure 32:
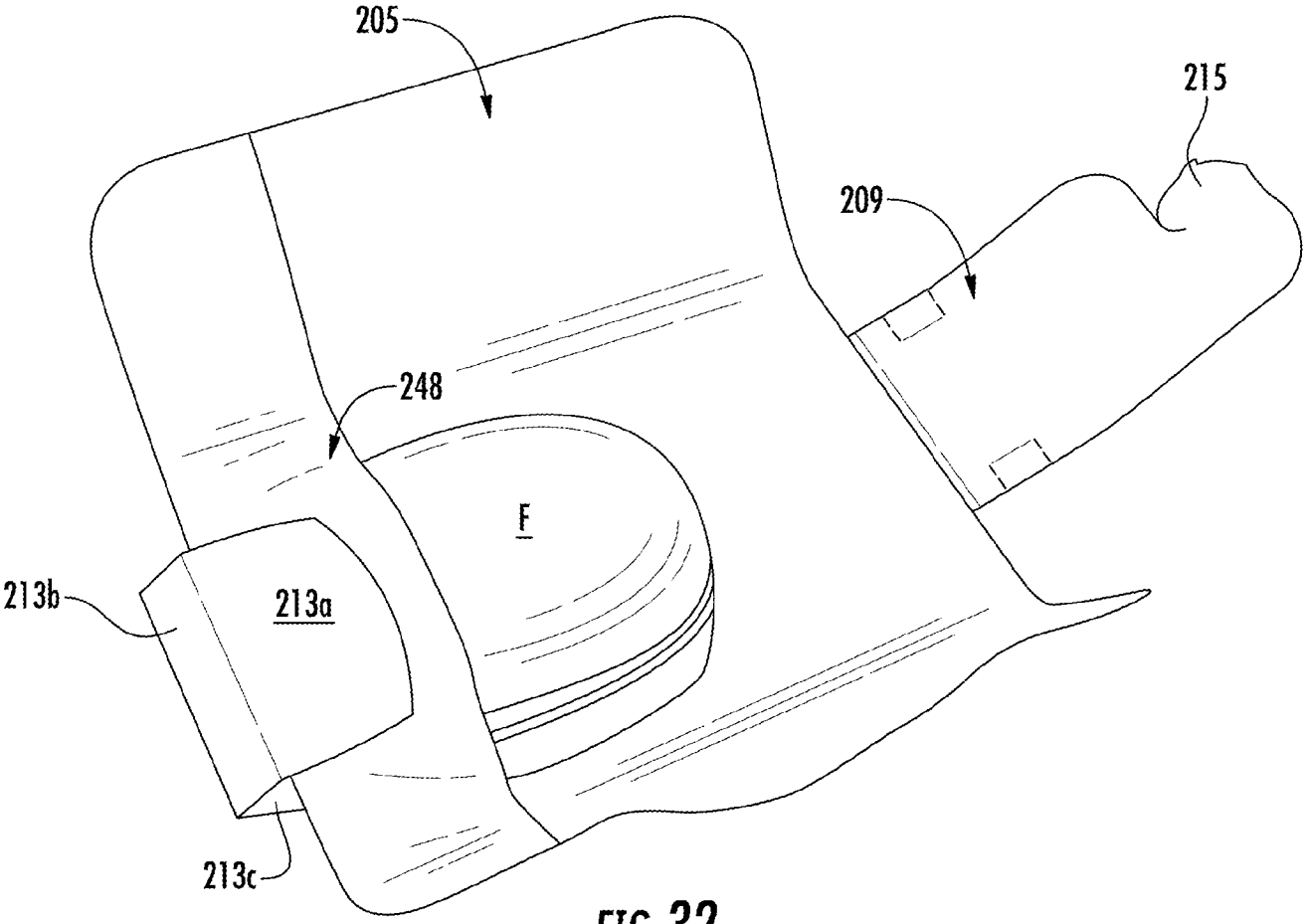
Figure 33:
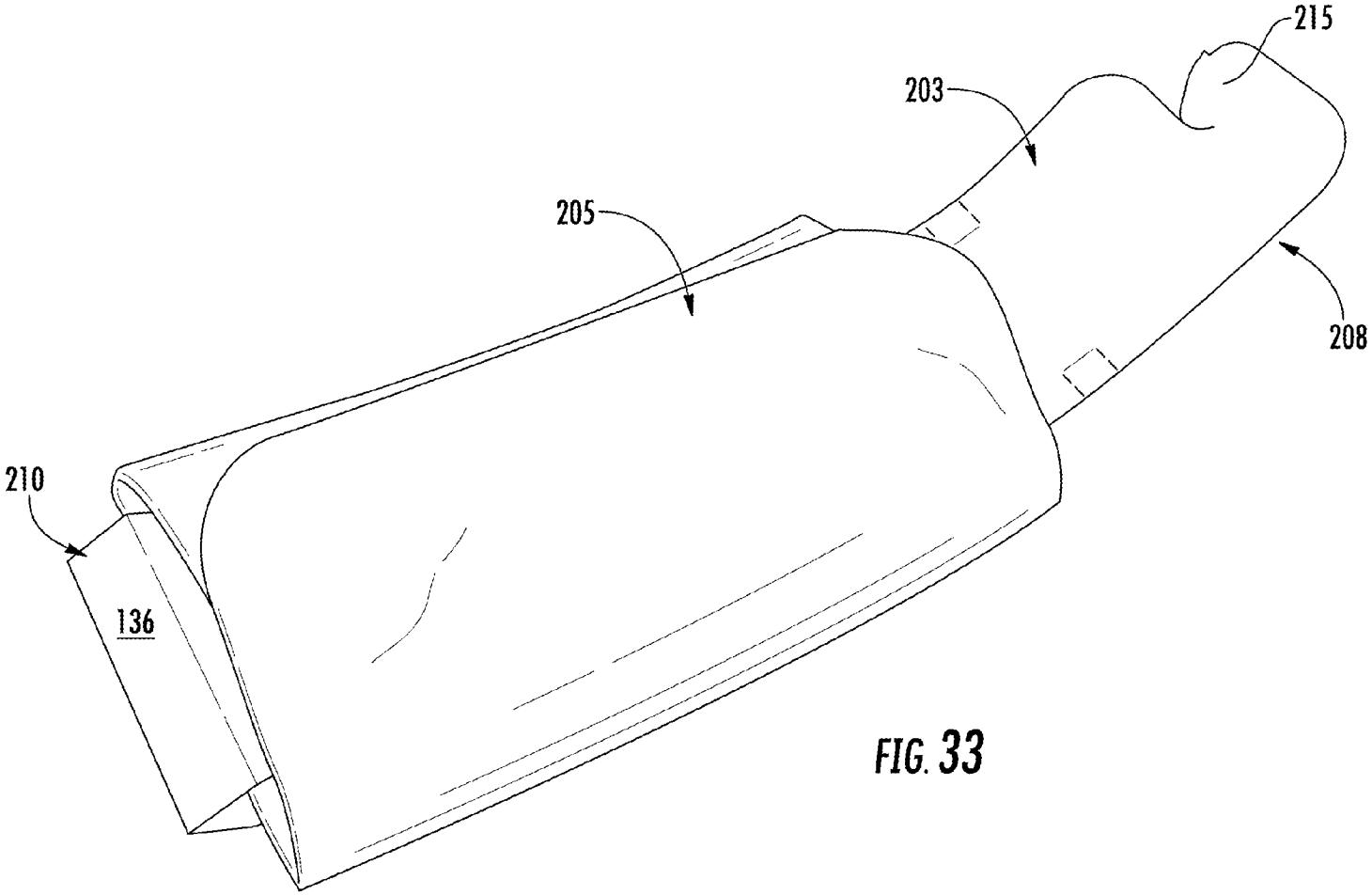
Figure 34:
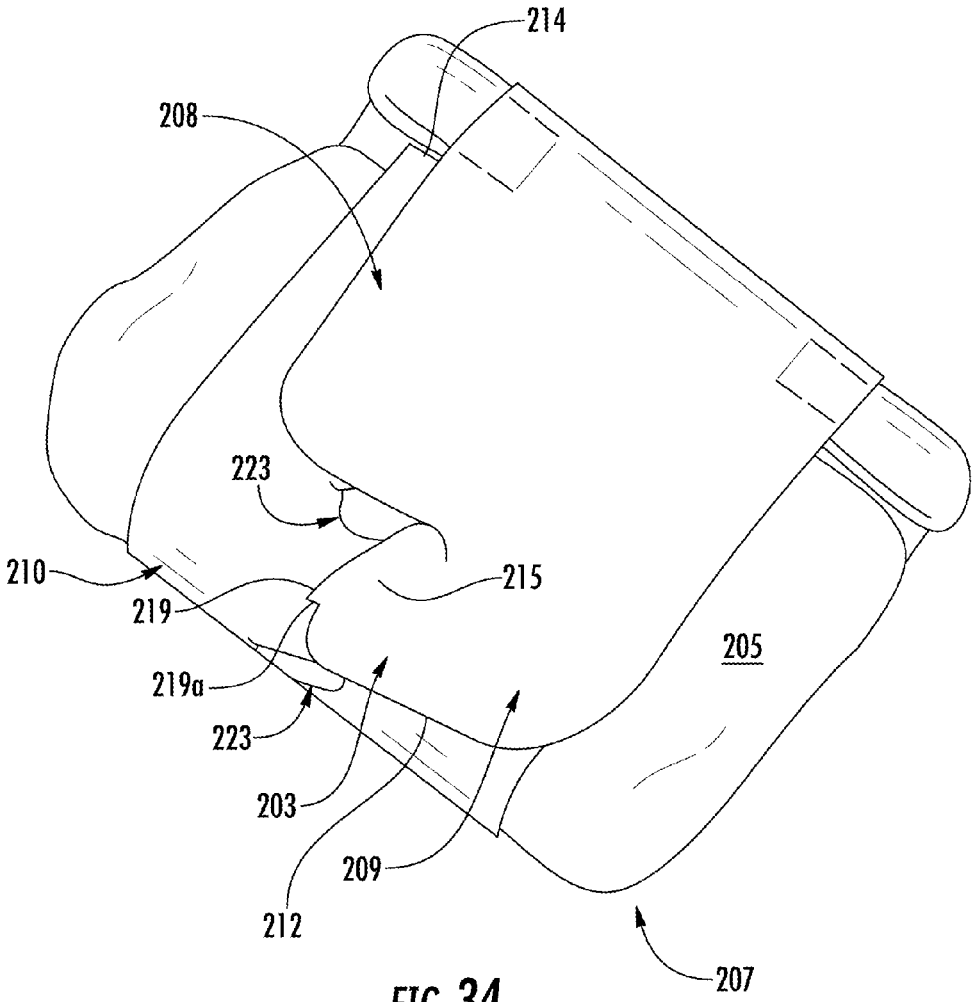
FIGS. 34 and 35 show the engagement of locking feature in a construct formed from the blank of FIG. 25 according to the fifth embodiment of the disclosure.

A food item F can be inserted at least partially into the pouch 248 as shown in FIG. 32. In one embodiment, the bottom gusset 252 of the liner allows expansion of the pouch 248 to accommodate various sizes of food product F in the package 207. The end portions of the liner 205 can be folded over the food item and one or more of the panels 213*a*, 213*b*, 213*c* as shown in FIG. 33. As shown in FIG. 34, the first portion 208 of the blank 205 can be folded over the second portion 210 and the food item F, the top marginal portion of the liner 205 folding over the food item F as well to form the construct 209 that encircles the food product. Accordingly, FIG. 34 shows the liner 205 and the construct 209 wrapped around the food item F to enclose the food item, and the first portion 208 of the construct 209 overlaps the second portion 210 of the construct. As shown in FIGS. 34-37, the first portion 208 of the construct 209 at least partially overlaps the panels 213*a*, 213*b*, 213*c*.

Figure 35:
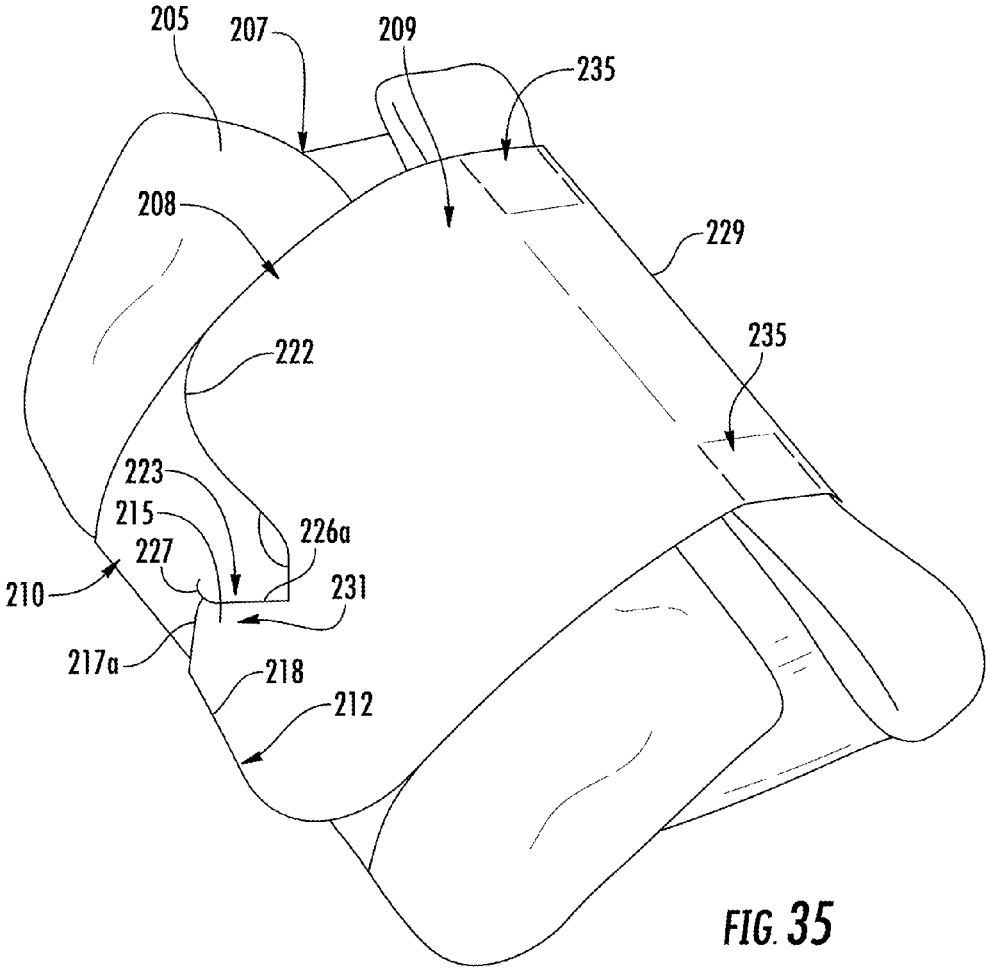
Figure 36:
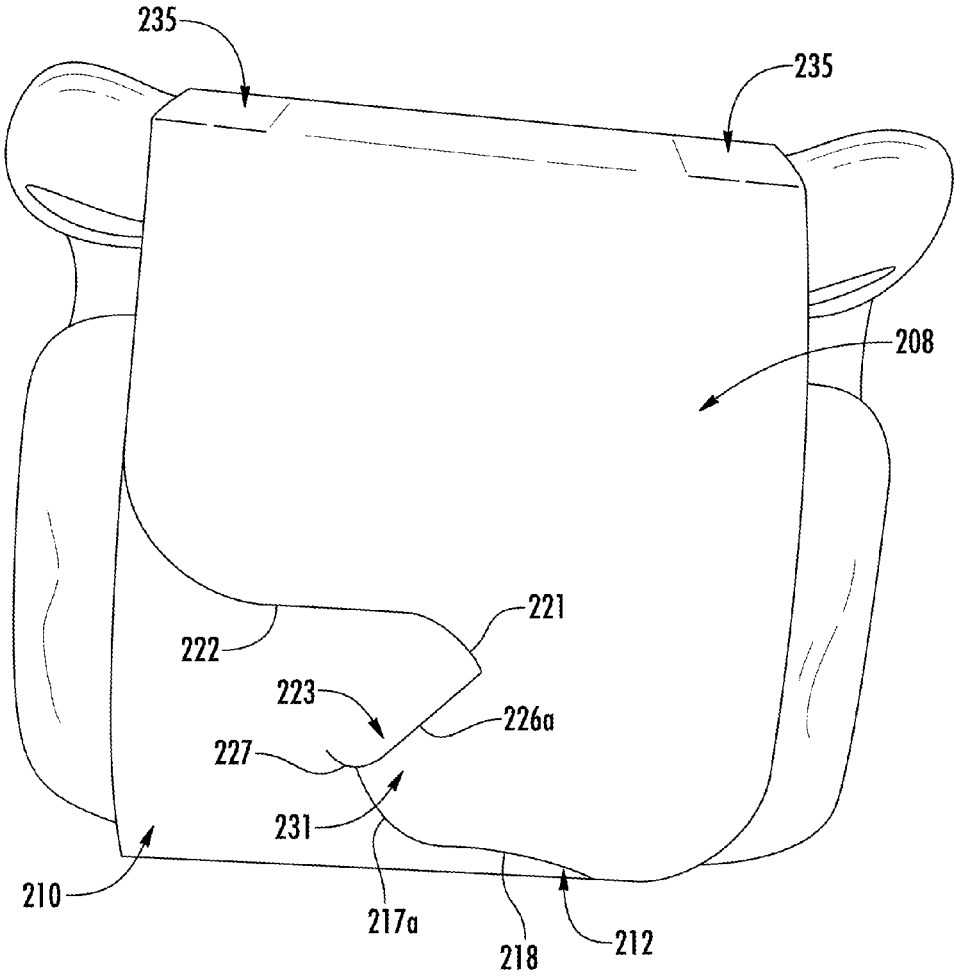
FIG. 36 is a perspective view of the package formed from the liner and the blank of FIG. 29 according to the fifth embodiment of the disclosure.
Figure 37:
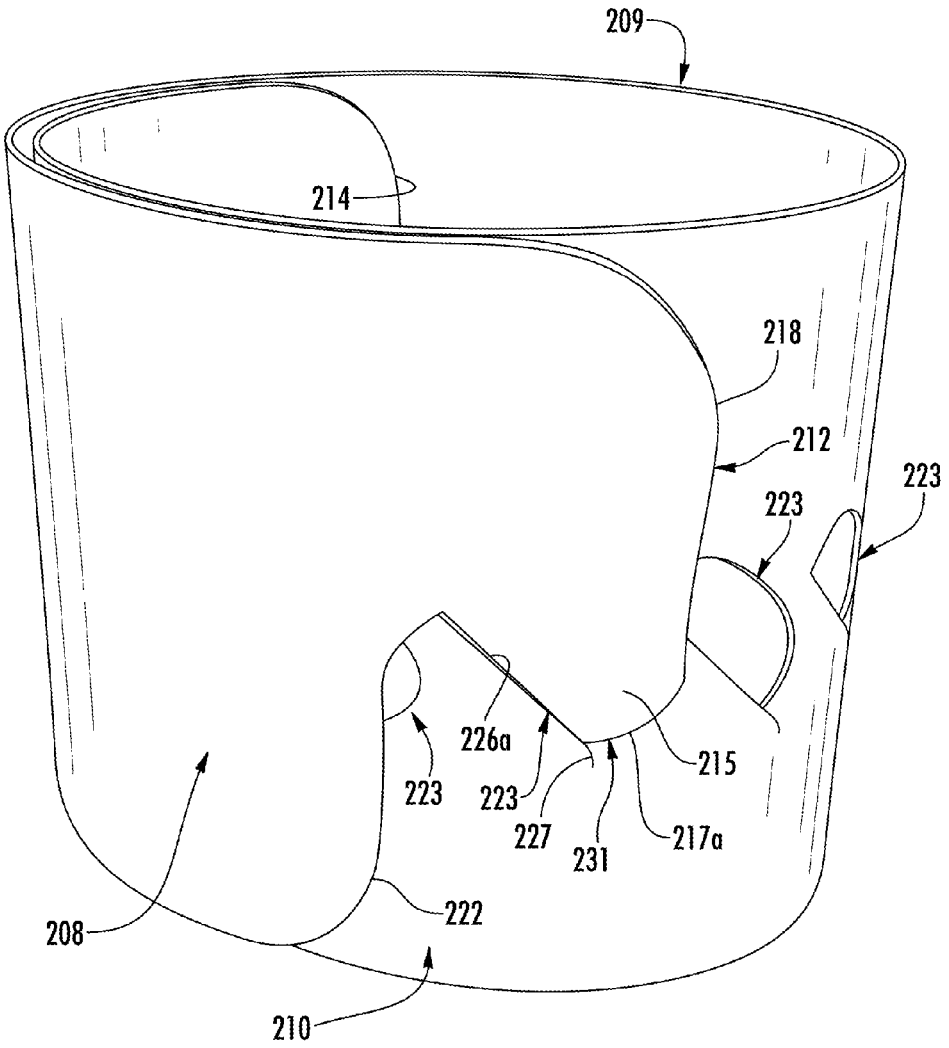
FIG. 37 is a perspective of the construct formed from the blank of FIG. 25 with a remainder of the package omitted for clarity according to the fifth embodiment of the disclosure.

As shown in FIGS. 35 and 36, the male locking tab 231 is inserted into a selected female locking opening 225 of the selected female locking feature 223 based on the size of the food product and the tightness of the fit of the construct 209 around the food product. As the male locking tab 231 is inserted into the selected opening 225, the protrusion 219 of the male locking feature 215 can pass through the respective opening and/or through the curved cut 227 of the female locking feature 223. Once engaged, the edge 219*a* of the protrusion 219 can catch against the construct at the curved cut 227 and/or at edge of the opening 225 to help prevent the male locking tab 231 from be prematurely removed from the opening and to help retain the male locking tab 231 against the locking edge 226*a* of the opening 225. FIG. 37 illustrates the engagement of the male locking feature 215 with the female locking feature 223 in the construct 209 with the liner 205 and the food item F omitted for clarity. In one embodiment, the fold lines 11 and the panels 213*a*, 213*b*, 213*c* facilitate the formation of the pouch 248 by allowing the liner 205 to expand and hold the food product F. Additionally, the lateral fold lines 11, 229 can help the construct 209 to at least partially conform to the shape of the food item F. The package 207 could be formed by additional or different steps without departing from the disclosure. Additionally, the first portion 208 and the second portion 210 of the construct 209 can be otherwise engaged and/or secured to one another. For example, in addition or alternatively to the male locking feature 215 and the female locking features 223, the first portion 208 and the second portion 210 could be secured together by an adhesive (e.g., an adhesive sticker, retack glue, and/or tape) or any other suitable securing method. In one embodiment, an adhesive sticker and/or any other suitable securing method could be applied to the liner 205 to secure portions of the liner to one another and/or to the construct 209.

In one embodiment, the package 207 can be formed in a similar manner in a system and method 100 of forming reinforced packages as shown and disclosed in U.S. Provisional Patent Application No. 62/179,480, filed on May 8, 2015, that is incorporated by reference herein for all purposes. As disclosed in the '480 patent application, the liner 5 can be formed by attaching a web of liner material to the blank 3 to form an attached web and moving the attached web through a packaging machine to form the liner 5 having the gusseted bottom portion and the pouch 48. Further, the package 207 can be formed in any other suitable manner without departing from the disclosure.

Any of the features of the various embodiments of the disclosure can be combined with, replaced by, or otherwise configured with other features of other embodiments of the disclosure without departing from the scope of this disclosure.

Generally, as described herein, liners or bags can be formed from a bag stock material, although various plastic or other bag materials also can be used, and can be lined or coated with a desired material. The reinforcing cartons described herein can be made from a more rigid material such as a clay-coated natural kraft ("CCNK"). Other materials such various card-stock, paper, plastic or other synthetic or natural materials also can be used to form the components of the packages described herein.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels or components adhered together by glue during erection of the carton embodiments. The term "glue" is intended to encompass all manner of adhesives commonly used to secure carton panels in place.

The foregoing description of the disclosure illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure without departing from the scope of the disclosure.

What is claimed is:

1. A package for holding a product, the package comprising:

a liner for at least partially receiving the product and at least partially wrapping around the product; and a construct wrapped at least partially around the liner, the construct comprising a first portion at a first end of the construct and a second portion proximate to a second end of the construct, the first portion at least partially overlapping and engaging the second portion;

wherein the construct comprises a first locking feature in the first portion, a second locking feature in the second portion, and a plurality of lateral fold lines extending in the second portion, the plurality of fold lines forming panels in the second portion, the second locking feature being spaced from the second end by at least the panels, and the first portion at least partially overlapping the panels.

2. The package of claim 1, wherein the first locking feature at least partially engages the second locking feature to at least partially retain the first portion in engagement with the second portion.

3. The package of claim 1, wherein the first locking feature comprises a male locking tab and the second locking feature comprises a female locking feature, and the male locking tab at least partially engages the female locking feature.

4. The package of claim 3, wherein the male locking tab is at least partially formed by a cut in the construct, the female locking feature comprises a locking edge of the construct, and the male locking tab engages the locking edge.

5. The package of claim 4, wherein the construct comprises a length extending from a first end of the construct to a second end of the construct, and the male locking tab and the locking edge of the female locking feature are closer to the respective first end and second end along the length of the construct relative to one another.

6. The package of claim 3, wherein the first end comprises a lateral edge of the construct, and the male locking tab comprises a generally curved edge of the construct extending from the lateral edge at the first end.

7. The package of claim 6, wherein a cut extending in the construct from the generally curved edge at least partially forms the male locking tab.

8. The package of claim 6, wherein the female locking feature comprises a female locking opening comprising a locking edge, and the male locking tab extends at least partially through the female locking opening and at least partially engages the locking edge.

9. The package of claim 8, wherein the locking edge is a generally straight locking edge, the female locking opening comprises a generally curved locking edge, and at least a portion of the generally curved locking edge is disposed opposite to the generally straight locking edge.

10. The package of claim 8, wherein the male locking tab comprises a protrusion extending from the generally curved edge of the construct, the female locking opening comprises a locking cut extending from the locking edge of the female locking opening, and the protrusion of the male locking tab at least partially engages the construct adjacent the locking cut for at least partially retaining the male locking tab in engagement with the locking edge.

11. The package of claim 1, wherein the liner comprises a pouch for at least partially receiving the product.

12. The package of claim 11, wherein the pouch comprises a bottom marginal portion of the liner folded over a central portion of the liner, the pouch being for at least partially receiving the product between the bottom marginal portion and the central portion.

13. The package of claim 12, wherein the bottom marginal portion of the liner is connected to the central portion of the liner by a gusset, the gusset at least partially forming a bottom of the pouch.

14. The package of claim 13, wherein the gusset comprises a first gusset panel foldably connected to a second gusset panel along a first fold, the first gusset panel is foldably connected to the bottom marginal portion of the liner along a second fold, and the second gusset panel is foldably connected to the central portion along a third fold.

15. The package of claim 12, wherein the construct extends around the package in a direction, the construct comprises a transverse width that is generally perpendicular to the direction, the bottom marginal portion of the liner is folded along at least a fold, and at least a portion of the fold is generally parallel to the transverse with of the construct.

16. The package of claim 15, wherein a top marginal portion of the liner at least partially overlaps the pouch.

17. The package of claim 1, wherein:

the first locking feature comprises a male locking tab extending at the first end of the construct, the male locking tab is at least partially formed by a cut in the construct the second locking feature comprises a female locking opening and a locking edge;

the male locking tab extends at least partially through the female locking opening and at least partially engages the locking edge so that the locking edge is at least partially inserted into the cut.

18. The package of claim 17, wherein the first end of the construct comprises a lateral edge of the construct, and the male locking tab comprises a curved edge of the construct extending from the cut to the lateral edge.

19. The package of claim 18, wherein the male locking tab comprises a protrusion, the protrusion comprises a generally straight edge extending from the curved edge of the construct, the female locking opening comprises a locking cut extending from the locking edge of the female locking opening, and the generally straight edge of the protrusion at least partially engages the construct at the locking cut for at least partially retaining the male locking tab in engagement with the locking edge.

* * * * *